US008578725B2

(12) United States Patent
Nishimura

(10) Patent No.: US 8,578,725 B2
(45) Date of Patent: Nov. 12, 2013

(54) AIR CONDITIONING APPARATUS AND REFRIGERANT QUANTITY DETERMINATION METHOD

(75) Inventor: Tadafumi Nishimura, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 758 days.

(21) Appl. No.: 12/808,729

(22) PCT Filed: Dec. 24, 2008

(86) PCT No.: PCT/JP2008/073370

§ 371 (c)(1),
(2), (4) Date: Jun. 17, 2010

(87) PCT Pub. No.: WO2009/008519

PCT Pub. Date: Jul. 9, 2009

(65) Prior Publication Data

US 2010/0275626 A1 Nov. 4, 2010

(30) Foreign Application Priority Data

Dec. 28, 2007 (JP) ..... 2007-340778

(51) Int. Cl.
*F25B 45/00* (2006.01)
*F25B 41/04* (2006.01)

(52) U.S. Cl.
USPC ..... 62/149; 62/205

(58) Field of Classification Search
USPC ..... 62/149, 174, 238.7, 205, 513
See application file for complete search history.

(56) References Cited

U.S. PATENT DOCUMENTS

| | | | | |
|---|---|---|---|---|
| 4,308,725 | A * | 1/1982 | Chiyoda | 62/129 |
| 4,794,763 | A * | 1/1989 | Kikuchi | 62/228.1 |
| 2008/0209926 | A1 | 9/2008 | Matsuoka et al. | |

FOREIGN PATENT DOCUMENTS

| | | | | |
|---|---|---|---|---|
| JP | 07-218008 | A | | 8/1995 |
| JP | 11-83250 | A | | 3/1999 |
| JP | 2001-21242 | A | | 1/2001 |
| JP | 2002228281 | A | * | 8/2002 |
| JP | 2005-257219 | A | | 9/2005 |
| JP | 2006-23072 | A | | 1/2006 |
| JP | 2006-58007 | A | | 3/2006 |
| JP | 2006234239 | A | * | 9/2006 |
| JP | 2007-163103 | A | | 6/2007 |

OTHER PUBLICATIONS

International Search Report of corresponding PCT Application No. PCT/JP2008/073370.
International Preliminary Report of corresponding PCT Application No. PCT/JP2008/073370.

* cited by examiner

*Primary Examiner* — Chen Wen Jiang
(74) *Attorney, Agent, or Firm* — Global IP Counselors

(57) ABSTRACT

An air conditioning apparatus includes a refrigerant circuit, first and second shut-off mechanisms, a communication pipe and a refrigerant detection mechanism. The refrigerant circuit is configured to at least perform a cooling operation. The first shut-off mechanism is downstream of the receiver and upstream of the liquid refrigerant connection pipe when the cooling operation is performed. The second shut-off mechanism is downstream of the heat source-side heat exchanger and upstream of the receiver when the cooling operation is performed. The communication pipe interconnects the refrigerant circuit between the first and second shut-off mechanisms, and the refrigerant circuit on the suction side of the compressor. The refrigerant detection mechanism is upstream of the second shut-off mechanism when the cooling operation is performed. The refrigerant detection mechanism is configured to detect a state quantity relating to the quantity of the refrigerant existing on the upstream side of the second shut-off mechanism.

8 Claims, 12 Drawing Sheets

AIR CONDITIONING APPARATUS AND REFRIGERANT QUANTITY DETERMINATION METHOD

CROSS-REFERENCE TO RELATED APPLICATIONS

This U.S. National stage application claims priority under 35 U.S.C. §119(a) to Japanese Patent Application No. 2007-340778, filed in Japan on Dec. 28, 2007, the entire contents of which are hereby incorporated herein by reference.

TECHNICAL FIELD

The present invention relates to the function of determining the properness of the quantity of refrigerant inside a refrigerant circuit of an air conditioning apparatus and particularly relates to the function of determining the properness of the quantity of refrigerant inside a refrigerant circuit of an air conditioning apparatus configured as a result of a heat source unit having a compressor, a heat source-side heat exchanger and a receiver and a utilization unit having a utilization-side expansion mechanism and a utilization-side heat exchanger being interconnected via a liquid refrigerant connection pipe and a gas refrigerant connection pipe.

BACKGROUND ART

Conventionally, in order to determine the properness of the quantity of refrigerant inside a refrigerant circuit of an air conditioning apparatus configured as a result of a heat source unit having a compressor, a heat source-side heat exchanger and a receiver and a utilization unit having a utilization-side expansion valve and a utilization-side heat exchanger being interconnected via a liquid refrigerant connection pipe and a gas refrigerant connection pipe, the air conditioning apparatus is operated under a predetermined condition (See Japanese Patent Publication No. 2006-023072). As this operation under a predetermined condition, there is, for example, operation where the degree of superheating of the refrigerant in the outlet of the utilization-side heat exchanger functioning as an evaporator of the refrigerant is controlled such that it becomes a positive value and where the pressure of the refrigerant on the low pressure side of the refrigerant circuit is controlled such that it becomes constant.

SUMMARY

An air conditioning apparatus according to a first aspect of the invention comprises a refrigerant circuit, a first shut-off mechanism, a second shut-off mechanism, a communication pipe and a refrigerant detection mechanism. The refrigerant circuit includes a heat source unit having a compressor, a heat source-side heat exchanger and a receiver, a utilization unit having a utilization-side expansion mechanism and a utilization-side heat exchanger, and a liquid refrigerant connection pipe and a gas refrigerant connection pipe that interconnect the heat source unit and the utilization unit, with the refrigerant circuit being capable of performing at least cooling operation where the heat source-side heat exchanger is caused to function as a condenser of refrigerant compressed in the compressor and where the utilization-side heat exchanger is caused to function as an evaporator of the refrigerant sent through the receiver, the liquid refrigerant connection pipe and the utilization-side expansion mechanism after being condensed in the heat source-side heat exchanger. The first shut-off mechanism is placed on the downstream side of the receiver and on the upstream side of the liquid refrigerant connection pipe in the flow direction of the refrigerant in the refrigerant circuit when performing the cooling operation and is capable of shutting off passage of the refrigerant. The second shut-off mechanism is placed on the downstream side of the heat source-side heat exchanger and on the upstream side of the receiver in the flow direction of the refrigerant in the refrigerant circuit when performing the cooling operation and is capable of shutting off passage of the refrigerant. The communication pipe interconnects the portion of the refrigerant circuit between the first shut-off mechanism and the second shut-off mechanism and the portion of the refrigerant circuit on the suction side of the compressor. The refrigerant detection mechanism is placed on the upstream side of the second shut-off mechanism in the flow direction of the refrigerant in the refrigerant circuit when performing the cooling operation and detects a state quantity relating to the quantity of the refrigerant existing on the upstream side of the second shut-off mechanism.

In conventional (Japanese Patent Publication No. 2006-023072) refrigerant quantity properness determination, there is employed a technique where various operation controls are performed as operation conditions for determining the refrigerant quantity, so this has been somewhat cumbersome.

Thus, the inventor of the present application discovered performing determination of the proper refrigerant quantity by sealing, with a utilization-side expansion valve and a shut-off valve placed on the upstream side of the liquid refrigerant connection pipe in the flow direction of the refrigerant in the refrigerant circuit when performing cooling operation, the liquid refrigerant in the portion of the refrigerant circuit between the utilization-side expansion valve and the shut-off valve including the liquid refrigerant connection pipe and cutting off circulation of the refrigerant inside the refrigerant circuit with the shut-off valve to thereby accumulate, in the portion of the refrigerant circuit on the upstream side of the shut-off valve and on the downstream side of the compressor, the refrigerant condensed in the heat source-side heat exchanger functioning as a condenser, placing, by operation of the compressor, the refrigerant circuit in a state where the refrigerant is virtually nonexistent in the portion of the refrigerant circuit on the downstream side of the utilization-side expansion valve and on the upstream side of the compressor such as in the utilization-side heat exchanger and the gas refrigerant connection pipe, and in this state detecting, with the refrigerant detection mechanism, the state quantity relating to the quantity of the refrigerant that has been intensively collected in the portion of the refrigerant circuit on the upstream side of the shut-off valve and on the downstream side of the compressor.

However, when the refrigerant quantity determination technique described above is applied in an air conditioning apparatus where a receiver exists on the upstream side of the shut-off valve in the flow direction of the refrigerant in the refrigerant circuit when performing the cooling operation, when the liquid refrigerant is sealed, by the utilization-side expansion valve and the shut-off valve, in the portion of the refrigerant circuit between the utilization-side expansion valve and the shut-off valve including the liquid refrigerant connection pipe and circulation of the refrigerant inside the refrigerant circuit is cut off by the shut-off valve so that the refrigerant gradually accumulates in the portion of the refrigerant circuit on the upstream side of the shut-off valve and on the downstream side of the compressor, the quantity of the liquid refrigerant accumulating inside the receiver becomes inconstant because the receiver occupies a relatively large volume in the portion of the refrigerant circuit on the upstream side of the shut-off valve and on the downstream side of the compressor, and thus there is the fear that the precision of detection of the state quantity relating to the refrigerant quantity by the refrigerant detection mechanism will end up becoming low and that determination of the proper refrigerant quantity will become unable to be performed. With respect thereto, although it is also not inconceivable for the air conditioning apparatus to operate such that the inside of the receiver is filled with the liquid refrigerant, this is not preferable because there arises the need to increase the quantity of the refrigerant charged inside the refrigerant circuit in order to ensure that the inside of the receiver can be filled with the liquid refrigerant. Further, when the refrigerant quantity determination technique described above is applied in an air conditioning apparatus where a receiver exists on the downstream side of the shut-off valve in the flow direction of the refrigerant in the refrigerant circuit when performing the cooling operation, even at the stage before the liquid refrigerant is sealed, by the utilization-side expansion valve and the shut-off valve, in the portion of the refrigerant circuit between the utilization-side expansion valve and the shut-off valve including the liquid refrigerant connection pipe and circulation of the refrigerant inside the refrigerant circuit is cut off by the utilization-side expansion valve and the shut-off valve, the quantity of the refrigerant existing inside the receiver becomes inconstant, so even at the stage after circulation of the refrigerant inside the refrigerant circuit has been cut off by the utilization-side expansion valve and the shut-off valve, the quantity of the refrigerant sealed in the portion of the refrigerant circuit between the utilization-side expansion valve and the shut-off valve becomes inconstant, and thus there is the fear that the precision of detection of the state quantity relating to the refrigerant quantity by the refrigerant detection mechanism will end up becoming low and that determination of the proper refrigerant quantity will become unable to be performed.

Thus, in this air conditioning apparatus, the second shut-off mechanism is disposed on the downstream side of the heat source-side heat exchanger and on the upstream side of the receiver in the flow direction of the refrigerant in the refrigerant circuit when performing the cooling operation, and the communication pipe that interconnects the portion of the refrigerant circuit between the first shut-off mechanism and the second shut-off mechanism and the portion of the refrigerant circuit on the suction side of the compressor is disposed. Thus, when the refrigerant circuit performs the cooling operation, the liquid refrigerant can be sealed, by the utilization-side expansion mechanism and the first shut-off mechanism, in the portion of the refrigerant circuit between the utilization-side expansion mechanism and the first shut-off mechanism including the liquid refrigerant connection pipe, passage of the refrigerant between the portion of the refrigerant circuit between the first shut-off mechanism and the second shut-off mechanism including the receiver and the other portion of the refrigerant circuit can be shut off by the first shut-off mechanism and the second shut-off mechanism, and the portion of the refrigerant circuit between the first shut-off mechanism and the second shut-off mechanism and the portion of the refrigerant circuit on the suction side of the compressor can be interconnected by the communication pipe. Additionally, when these operations are performed, the refrigerant condensed in the heat source-side heat exchanger functioning as a condenser gradually accumulates in the portion of the refrigerant circuit on the upstream side of the second shut-off mechanism and on the downstream side of the compressor such in as the heat source-side heat exchanger because circulation of the refrigerant inside the refrigerant circuit is cut off by the second shut-off mechanism. Moreover, because of operation of the compressor, the refrigerant becomes virtually nonexistent in the portion of the refrigerant circuit on the downstream side of the utilization-side expansion mechanism and on the upstream side of the compressor such as in the utilization-side heat exchanger and the gas refrigerant connection pipe, and the refrigerant becomes virtually nonexistent inside the receiver also because the refrigerant inside the receiver is also sucked into the compressor through the communication pipe. Thus, the refrigerant inside the refrigerant circuit becomes intensively collected in the portion of the refrigerant circuit on the upstream side of the second shut-off mechanism and on the downstream side of the compressor without accumulating inside the receiver, so the state quantity relating to the quantity of the refrigerant that has been collected in this portion can be detected by the refrigerant detection mechanism while suppressing a drop in detection precision resulting from the refrigerant accumulating inside the receiver, and it becomes possible to perform determination of the proper refrigerant quantity.

Thus, in this air conditioning apparatus, it becomes possible to perform determination of the proper refrigerant quantity while making the condition for performing determination relating to the refrigerant quantity simple.

An air conditioning apparatus according to a second aspect of the invention is the air conditioning apparatus according to the first aspect of the invention, further comprising an operation controlling element or means and a refrigerant quantity determining element or means. The operation controlling element is capable of performing refrigerant quantity determination operation that performs operation where the liquid refrigerant is sealed, by the utilization-side expansion mechanism and the first shut-off mechanism, in the portion of the refrigerant circuit between the utilization-side expansion mechanism and the first shut-off mechanism including the liquid refrigerant connection pipe and where the refrigerant in the portion of the refrigerant circuit between the first shut-off mechanism and the second shut-off mechanism including the receiver is placed, by the second shut-off mechanism and the communication pipe, in a state where it is communicated with the suction side of the compressor so that the refrigerant compressed in the compressor is condensed in the heat source-side heat exchanger and is accumulated in the portion of the refrigerant circuit on the upstream side of the second shut-off mechanism including the heat source-side heat exchanger. The refrigerant quantity determining element determines the properness of the quantity of the refrigerant inside the refrigerant circuit on the basis of the state quantity relating to the quantity of the refrigerant that the refrigerant detection mechanism has detected in the refrigerant quantity determination operation.

This air conditioning apparatus can automatically perform at least determination of the properness of the refrigerant quantity because it further comprises the refrigerant quantity determining element.

An air conditioning apparatus according to a third aspect of the invention is the air conditioning apparatus according to the second aspect of the invention, further comprising a temperature regulation mechanism that is capable of regulating the temperature of the refrigerant sent from the heat source-side heat exchanger through the liquid refrigerant connection pipe to the utilization-side expansion mechanism before the liquid refrigerant is sealed, by the utilization-side expansion mechanism and the first shut-off mechanism, in the portion of the refrigerant circuit between the utilization-side expansion mechanism and the first shut-off mechanism including the liquid refrigerant connection pipe.

In this air conditioning apparatus, the temperature of the refrigerant in the liquid refrigerant connection pipe can be regulated such that it becomes constant by the temperature regulation mechanism before the liquid refrigerant is sealed in the portion of the refrigerant circuit between the utilization-side expansion mechanism and the first shut-off mechanism including the liquid refrigerant connection pipe, so in the refrigerant quantity determination operation, an accurate quantity of the liquid refrigerant where the temperature of the refrigerant has also been considered can be sealed in the portion of the refrigerant circuit between the utilization-side expansion mechanism and the first shut-off mechanism including the liquid refrigerant connection pipe.

Thus, for example, in the refrigerant quantity determination operation, a constant quantity of the refrigerant can always be sealed in the portion of the refrigerant circuit between the utilization-side expansion mechanism and the first shut-off mechanism including the liquid refrigerant connection pipe, so even when the length of the liquid refrigerant connection pipe configuring the refrigerant circuit is long and the quantity of the refrigerant sealed in the liquid refrigerant connection pipe is relatively large, an accurate quantity of the refrigerant can be sealed in the liquid refrigerant connection pipe, and thus affects with respect to the quantity of the refrigerant in the portion of the refrigerant circuit on the upstream side of the second shut-off mechanism and on the downstream side of the compressor can be suppressed so that stable detection of the state quantity relating to the refrigerant quantity by the refrigerant detection mechanism can be performed.

An air conditioning apparatus according to a fourth aspect of the invention is the air conditioning apparatus according to the third aspect of the invention, wherein the temperature regulation mechanism is a subcooler connected between the heat source-side heat exchanger and the liquid refrigerant connection pipe. The communication pipe has a communication pipe expansion mechanism that regulates the flow rate of the refrigerant, with the communication pipe being capable of allowing some of the refrigerant sent from the heat source-side heat exchanger through the liquid refrigerant connection pipe to the utilization-side expansion mechanism to branch from between the first shut-off mechanism and the second shut-off mechanism, introducing the branched refrigerant to the subcooler after the branched refrigerant has been depressurized by the communication pipe expansion mechanism, allowing the branched refrigerant to exchange heat with the refrigerant sent from the heat source-side heat exchanger through the liquid refrigerant connection pipe to the utilization-side expansion mechanism, and returning the branched refrigerant to the suction side of the compressor.

In this air conditioning apparatus, the refrigerant flowing through the communication pipe is used as a cooling source of the subcooler serving as the temperature regulation mechanism, so the configuration for placing the refrigerant in a state where it is virtually nonexistent inside the receiver and the configuration for regulating the temperature of the refrigerant in the liquid refrigerant connection pipe such that it becomes constant become used combinedly.

Thus, in this air conditioning apparatus, complication of the configuration for performing determination relating to the refrigerant quantity can be suppressed.

An air conditioning apparatus according to a fifth aspect of the invention is the air conditioning apparatus according to any of the first to fourth aspects of the invention, wherein in the receiver, there is disposed a receiver bottom portion temperature detection mechanism for detecting the temperature of the refrigerant in a bottom portion of the receiver.

In this air conditioning apparatus, whether or not the liquid refrigerant is accumulating inside the receiver can be reliably detected because the receiver bottom portion temperature detection mechanism is disposed.

Thus, in this air conditioning apparatus, stable detection of the state quantity relating to the refrigerant quantity by the refrigerant detection mechanism can be performed.

A refrigerant quantity determination method according to a sixth aspect of the invention is a refrigerant quantity determination method of determining, in an air conditioning apparatus equipped with a refrigerant circuit that includes a heat source unit having a compressor, a heat source-side heat exchanger and a receiver, a utilization unit having a utilization-side expansion mechanism and a utilization-side heat exchanger, and a liquid refrigerant connection pipe and a gas refrigerant connection pipe that interconnect the heat source unit and the utilization unit, with the refrigerant circuit being capable of performing at least cooling operation where the heat source-side heat exchanger is caused to function as a condenser of refrigerant compressed in the compressor and where the utilization-side heat exchanger is caused to function as an evaporator of the refrigerant sent through the receiver, the liquid refrigerant connection pipe and the utilization-side expansion mechanism after being condensed in the heat source-side heat exchanger, the quantity of the refrigerant in the refrigerant circuit, the method comprising: performing refrigerant quantity determination operation where the liquid refrigerant is sealed, by a first shut-off mechanism that is placed on the downstream side of the receiver and on the upstream side of the liquid refrigerant connection pipe in the flow direction of the refrigerant in the refrigerant circuit when performing the cooling operation and is capable of shutting off passage of the refrigerant and by the utilization-side expansion mechanism, in the portion of the refrigerant circuit between the utilization-side expansion mechanism and the first shut-off mechanism including the liquid refrigerant connection pipe and where, by a second shut-off mechanism that is placed on the downstream side of the heat source-side heat exchanger and on the upstream side of the receiver in the flow direction of the refrigerant in the refrigerant circuit when performing the cooling operation and is capable of shutting off passage of the refrigerant and by a communication pipe that interconnects the portion of the refrigerant circuit between the first shut-off mechanism and the second shut-off mechanism and the portion of the refrigerant circuit on the suction side of the compressor, the refrigerant in the portion of the refrigerant circuit between the first shut-off mechanism and the second shut-off mechanism including the receiver is placed in a state where it is communicated with the suction side of the compressor so that the refrigerant compressed in the compressor is condensed in the heat source-side heat exchanger and is accumulated in the portion of the refrigerant circuit on the upstream side of the second shut-off mechanism including the heat source-side heat exchanger; detecting, with a refrigerant detection mechanism that is placed on the upstream side of the second shut-off mechanism in the flow direction of the refrigerant in the refrigerant circuit when performing the cooling operation and detects a state quantity relating to the quantity of the refrigerant existing on the upstream side of the second shut-off mechanism, the state quantity relating to the quantity of the refrigerant existing on the upstream side of the second shut-off mechanism; and determining the properness of the quantity of the refrigerant inside the refrigerant circuit on the basis of the state quantity relating to the quantity of the refrigerant that the refrigerant detection mechanism has detected in the refrigerant quantity determination operation.

In this refrigerant quantity determination method, the refrigerant condensed in the heat source-side heat exchanger functioning as a condenser gradually accumulates in the portion of the refrigerant circuit on the upstream side of the second shut-off mechanism and on the downstream side of the compressor such in as the heat source-side heat exchanger because circulation of the refrigerant inside the refrigerant circuit is cut off by the second shut-off mechanism. Moreover, because of operation of the compressor, the refrigerant becomes virtually nonexistent in the portion of the refrigerant circuit on the downstream side of the utilization-side expansion mechanism and on the upstream side of the compressor such as in the utilization-side heat exchanger and the gas refrigerant connection pipe, and the refrigerant becomes virtually nonexistent inside the receiver also because the refrigerant inside the receiver is also sucked into the compressor through the communication pipe. Thus, the refrigerant inside the refrigerant circuit becomes intensively collected in the portion of the refrigerant circuit on the upstream side of the second shut-off mechanism and on the downstream side of the compressor without accumulating inside the receiver, so the state quantity relating the quantity of the refrigerant that has been collected in this portion can be detected by the refrigerant detection mechanism while suppressing a drop in detection precision resulting from the refrigerant accumulating inside the receiver, and it becomes possible to perform determination of the proper refrigerant quantity.

Thus, in this refrigerant quantity determination method, it becomes possible to perform determination of the proper refrigerant quantity while making the condition for performing determination relating to the refrigerant quantity simple.

DETAILED DESCRIPTION OF EMBODIMENT(S)

Embodiments of an air conditioning apparatus and a refrigerant quantity determination method according to the present invention will be described below on the basis of the drawings.

First Embodiment

(1) Configuration of Air Conditioning Apparatus

Figure 1:
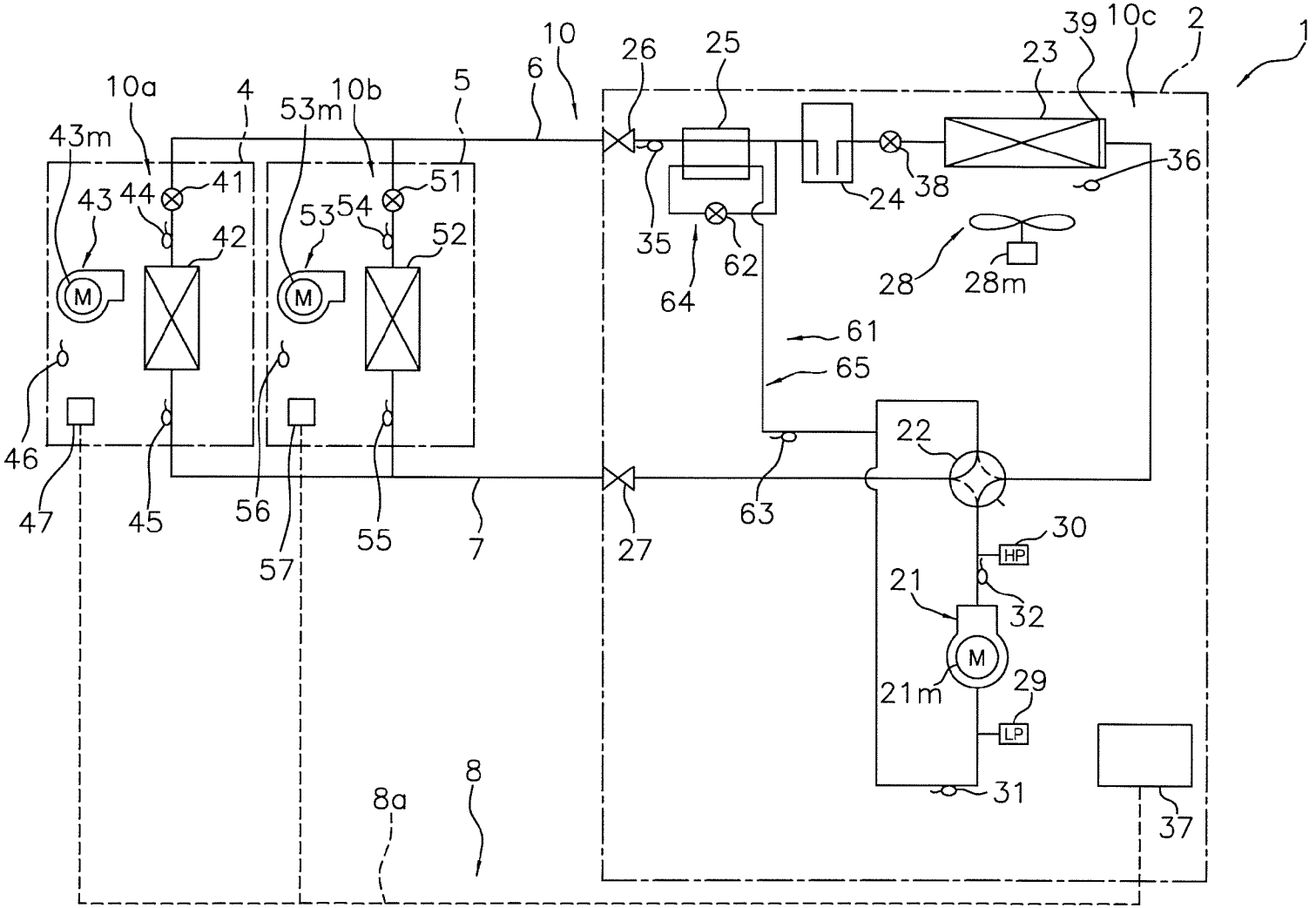
FIG. 1 is a general configuration diagram of an air conditioning apparatus according to a first embodiment of the present invention.

FIG. 1 is a general configuration diagram of an air conditioning apparatus 1 according to a first embodiment of the present invention. The air conditioning apparatus 1 is an apparatus used to cool and heat the inside of a room in a building or the like by performing vapor compression refrigeration cycle operation. The air conditioning apparatus 1 is mainly equipped with one outdoor unit 2 serving as a heat source unit, plural (in the present embodiment, two) indoor units 4 and 5 serving as utilization units that are connected in parallel to the outdoor unit 2, and a liquid refrigerant connection pipe 6 and a gas refrigerant connection pipe 7 serving as refrigerant connection pipes that interconnect the outdoor unit 2 and the indoor units 4 and 5. That is, a vapor compression refrigerant circuit 10 of the air conditioning apparatus 1 of the present embodiment is configured as a result of the outdoor unit 2, the indoor units 4 and 5 and the liquid refrigerant connection pipe 6 and the gas refrigerant connection pipe 7 being connected.

<Indoor Units>

The indoor units 4 and 5 are installed by being embedded in or hung from a ceiling inside a room in a building or the like or by being mounted on a wall surface inside a room. The indoor units 4 and 5 are connected to the outdoor unit 2 via the liquid refrigerant connection pipe 6 and the gas refrigerant connection pipe 7 and configure part of the refrigerant circuit 10.

Next, the configuration of the indoor units 4 and 5 will be described. The indoor unit 4 and the indoor unit 5 have the same configuration, so only the configuration of the indoor unit 4 will be described here, and in regard to the configuration of the indoor unit 5, reference numerals in the 50s will be added instead of reference numerals in the 40s representing each part of the indoor unit 4 and description of each part will be omitted.

The indoor unit 4 mainly has an indoor-side refrigerant circuit 10*a* (in the indoor unit 5, an indoor-side refrigerant circuit 10*b*) that configures part of the refrigerant circuit 10. This indoor-side refrigerant circuit 10*a* mainly has an indoor expansion valve 41 serving as a utilization-side expansion mechanism and an indoor heat exchanger 42 serving as a utilization-side heat exchanger.

In the present embodiment, the indoor expansion valve 41 is an electrical expansion valve connected to the liquid side of the indoor heat exchanger 42 in order to perform, for example, regulation of the flow rate of refrigerant flowing through the inside of the indoor-side refrigerant circuit 10*a*, and the indoor expansion valve 41 is also capable of shutting off passage of the refrigerant.

In the present embodiment, the indoor heat exchanger 42 is a cross-fin type fin-and-tube heat exchanger configured by heat transfer tubes and numerous fins and is a heat exchanger that functions as an evaporator of the refrigerant during cooling operation to cool the room air and functions as a condenser of the refrigerant during heating operation to heat the room air. In the present embodiment, the indoor heat exchanger 42 is a cross-fin type fin-and-tube heat exchanger, but it is not limited to this and may also be another type of heat exchanger.

In the present embodiment, the indoor unit 4 has an indoor fan 43 serving as a blowing fan for sucking the room air into the inside of the unit, allowing heat to be exchanged with the refrigerant in the indoor heat exchanger 42, and thereafter supplying the air to the inside of the room as supply air. The indoor fan 43 is a fan capable of varying the flow rate of the air it supplies to the indoor heat exchanger 42 and, in the present embodiment, is a centrifugal fan or a multiblade fan or the like driven by a motor 43*m* comprising a DC fan motor or the like.

Further, various types of sensors are disposed in the indoor unit 4. A liquid-side temperature sensor 44 that detects the temperature of the refrigerant (that is, the temperature of the refrigerant corresponding to the condensation temperature during the heating operation or the evaporation temperature during the cooling operation) is disposed on the liquid side of the indoor heat exchanger 42. A gas-side temperature sensor 45 that detects the temperature of the refrigerant is disposed on the gas side of the indoor heat exchanger 42. An indoor temperature sensor 46 that detects the temperature of the room air (that is, the indoor temperature) flowing into the inside of the unit is disposed on a room air suction opening side of the indoor unit 4. In the present embodiment, the liquid-side temperature sensor 44, the gas-side temperature sensor 45 and the indoor temperature sensor 46 comprise thermistors. Further, the indoor unit 4 has an indoor-side controller 47 that controls the operation of each part configuring the indoor unit 4. Additionally, the indoor-side controller 47 has a microcomputer and a memory and the like disposed in order to perform control of the indoor unit 4 and is configured such that it can exchange control signals and the like with a remote controller (not shown) for individually operating the indoor unit 4 and such that it can exchange control signals and the like with the outdoor unit 2 via a transmission line 8*a*.

<Outdoor Unit>

The outdoor unit 2 is installed outdoors of a building or the like, is connected to the indoor units 4 and 5 via the liquid refrigerant connection pipe 6 and the gas refrigerant connection pipe 7, and configures the refrigerant circuit 10 together with the indoor units 4 and 5.

Next, the configuration of the outdoor unit 2 will be described. The outdoor unit 2 mainly has an outdoor-side refrigerant circuit 10*c* that configures part of the refrigerant circuit 10. The outdoor-side refrigerant circuit 10*c* mainly has a compressor 21, a four-way switching valve 22, an outdoor heat exchanger 23 serving as a heat source-side heat exchanger, an outdoor expansion valve 38 serving as a second shut-off mechanism or a heat source-side expansion mechanism, a receiver 24, a subcooler 25 serving as a temperature regulation mechanism, a liquid-side stop valve 26 serving as a first shut-off mechanism, and a gas-side stop valve 27.

The compressor 21 is a compressor capable of varying its operating capacity and, in the present embodiment, is a positive displacement compressor driven by a motor 21*m* whose number of revolutions is controlled by an inverter. In the present embodiment, the compressor 21 comprises only one compressor, but the compressor 21 is not limited to this and two or more compressors may also be connected in parallel depending on the connection number of the indoor units and the like.

The four-way switching valve 22 is a valve for switching the direction of the flow of the refrigerant such that, during the cooling operation, the four-way switching valve 22 is capable of interconnecting the discharge side of the compressor 21 and the gas side of the outdoor heat exchanger 23 and also interconnecting the suction side of the compressor 21 and the gas refrigerant connection pipe 7 (see the solid lines of the four-way switching valve 22 in FIG. 1) to cause the outdoor heat exchanger 23 to function as a condenser of the refrigerant compressed by the compressor 21 and to cause the indoor heat exchangers 42 and 52 to function as evaporators of the refrigerant condensed in the outdoor heat exchanger 23 and such that, during the heating operation, the four-way switching valve 22 is capable of interconnecting the discharge side of the compressor 21 and the gas refrigerant connection pipe 7 and also interconnecting the suction side of the compressor 21 and the gas side of the outdoor heat exchanger 23 (see the dotted lines of the four-way switching valve 22 in FIG. 1) to cause the indoor heat exchangers 42 and 52 to function as condensers of the refrigerant compressed by the compressor 21 and to cause the outdoor heat exchanger 23 to function as an evaporator of the refrigerant condensed in the indoor heat exchangers 42 and 52.

Figure 2:
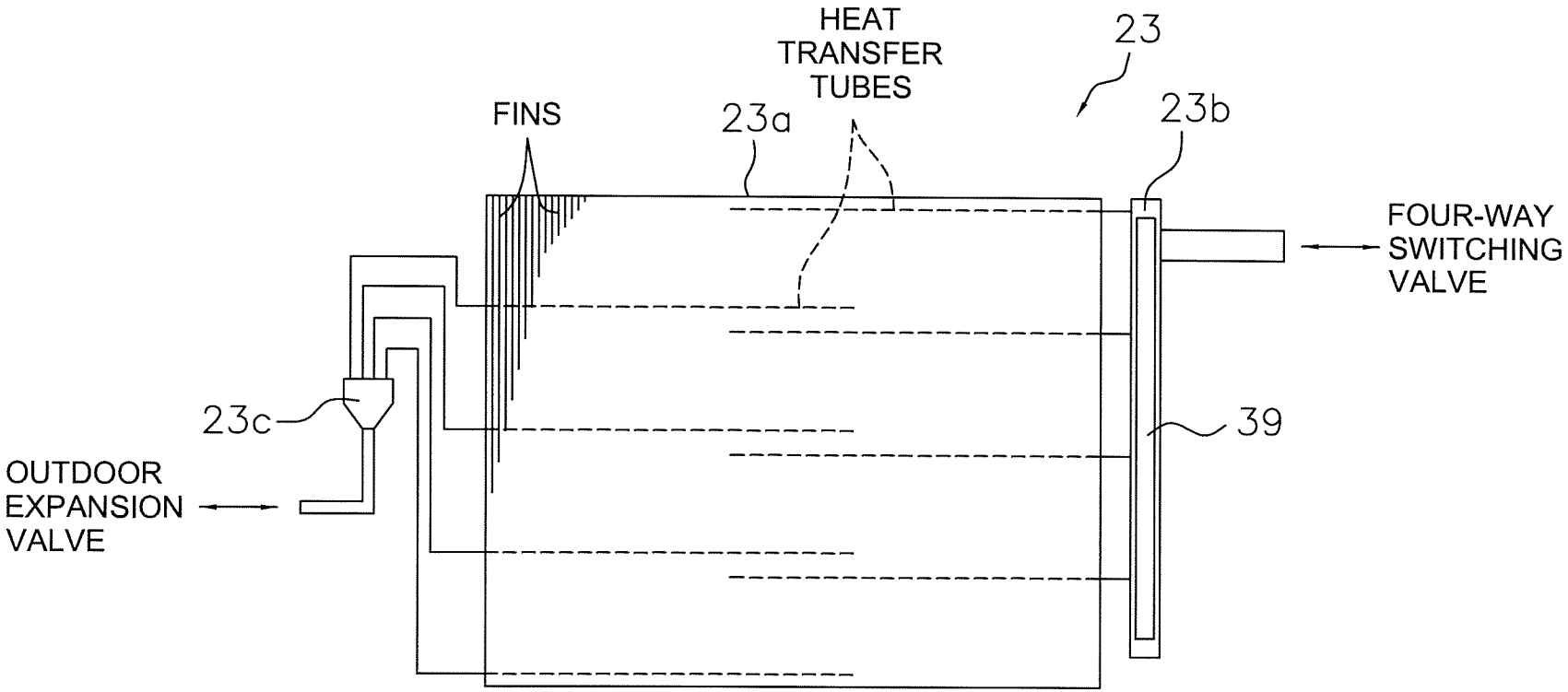
FIG. 2 is a general diagram of an outdoor heat exchanger.

In the present embodiment, the outdoor heat exchanger 23 is a cross-fin type fin-and-tube heat exchanger and, as shown in FIG. 2, mainly has a heat exchanger body 23*a* that is configured from heat transfer tubes and numerous fins, a header 23*b* that is connected to the gas side of the heat exchanger body 23*a*, and a distributor 23*c* that is connected to the liquid side of the heat exchanger body 23*a*. Here, FIG. 2 is a general diagram of the outdoor heat exchanger 23. The outdoor heat exchanger 23 is a heat exchanger that functions as a condenser of the refrigerant during the cooling operation and as an evaporator of the refrigerant during the heating operation. The gas side of the outdoor heat exchanger 23 is connected to the four-way switching valve 22, and the liquid side of the outdoor heat exchanger 23 is connected to the outdoor expansion valve 38. Further, on a side surface of the outdoor heat exchanger 23, as shown in FIG. 2, there is disposed a liquid level detection sensor 39 serving as a refrigerant detection mechanism that is placed on the upstream side of the outdoor expansion valve 38 in the flow direction of the refrigerant in the refrigerant circuit 10 when performing the cooling operation and detects a state quantity relating to the quantity of the refrigerant existing on the upstream side of the outdoor expansion valve 38. The liquid level detection sensor 39 is a sensor for detecting the quantity of the liquid refrigerant accumulating in the outdoor heat exchanger 23 as the state quantity relating to the quantity of the refrigerant existing on the upstream side of the outdoor expansion valve 38 and is configured by a tubular detection member placed along the height direction of the outdoor heat exchanger 23 (more specifically, the header 23*b*). Here, in the case of the cooling operation, high-temperature and high-pressure gas refrigerant discharged from the compressor 21 is cooled by air supplied by the outdoor fan 28, condenses, and becomes high-pressure liquid refrigerant inside the outdoor heat exchanger 23. That is, the liquid level detection sensor 39 detects, as the liquid level, the boundary between the region where the refrigerant exists in a gas state and the region where the refrigerant exists in a liquid state. The liquid level detection sensor 39 is not limited to such a tubular detection member and may also be configured by a temperature thermistor, such as thermistors placed in plural places along the height direction of the outdoor heat exchanger 23 (more specifically, the header 23*b*), for example, to detect, as the liquid level, the boundary between the portion in the outdoor heat exchanger 23 where gas refrigerant of a higher temperature than the ambient temperature exists and the portion in the outdoor heat exchanger 23 where liquid refrigerant of about the same temperature as the ambient temperature exists. In the present embodiment, the outdoor heat exchanger 23 is a cross-fin type fin-and-tube heat exchanger, but it is not limited to this and may also be another type of heat exchanger. Further, in the present embodiment, the header 23*b* is disposed on one end of the heat exchanger body 23*a* and the distributor 23*c* is disposed on the other end of the heat exchanger body 23*a*, but the outdoor heat exchanger 23 is not limited to this and may also be configured such that the header 23*b* and the distributor 23*c* are disposed on the same end portion of the outdoor heat exchanger body 23*a*.

In the present embodiment, the outdoor expansion valve 38 is an electrical expansion valve that is placed on the downstream side of the outdoor heat exchanger 23 and on the upstream side of the receiver 24 in the flow direction of the refrigerant in the refrigerant circuit 10 when performing the cooling operation (in the present embodiment, the outdoor expansion valve 38 is connected to the liquid side of the outdoor heat exchanger 23) in order to perform regulation, for example, of the pressure and flow rate of the refrigerant flowing through the inside of the outdoor-side refrigerant circuit 10*c* and is also capable of shutting off passage of the refrigerant.

In the present embodiment, the outdoor unit 2 has an outdoor fan 28 serving as a blowing fan for sucking outdoor air into the inside of the unit, allowing heat to be exchanged with the refrigerant in the outdoor heat exchanger 23, and thereafter expelling the air to the outdoors. This outdoor fan 28 is a fan capable of varying the flow rate of the air it supplies to the outdoor heat exchanger 23 and, in the present embodiment, is a propeller fan or the like driven by a motor 28*m* comprising a DC fan motor or the like.

The receiver 24 is connected between the outdoor expansion valve 38 and the liquid-side stop valve 26 and is a container capable of accumulating surplus refrigerant generated inside the refrigerant circuit 10 depending on, for example, differences in the circulation flow rates of the refrigerant between the cooling operation and the heating operation and fluctuations in the operating loads of the indoor units 4 and 5.

The subcooler 25 is, in the present embodiment, a double-tube heat exchanger or a pipe heat exchanger configured by allowing the refrigerant pipe through which the refrigerant condensed in the heat source-side heat exchanger flows and a bypass refrigerant pipe 61 described later to touch each other and is disposed between the outdoor heat exchanger 23 and the liquid refrigerant connection pipe 6 in order to cool the refrigerant sent to the indoor expansion valves 41 and 51 after being condensed in the outdoor heat exchanger 23. More specifically, the subcooler 25 is connected between the receiver 24 and the liquid-side stop valve 26.

In the present embodiment, there is disposed the bypass refrigerant pipe 61 serving as a cooling source of the subcooler 25. In the description below, the portion of the refrigerant circuit 10 excluding the bypass refrigerant pipe 61 will be called a main refrigerant circuit for the sake of convenience. The bypass refrigerant pipe 61 is connected to the main refrigerant circuit so as to allow some of the refrigerant sent from the outdoor heat exchanger 23 to the indoor expansion valves 41 and 51 to branch from the main refrigerant circuit, introduce the branched refrigerant to the subcooler 25 after depressurizing the branched refrigerant, allow the branched refrigerant to exchange heat with the refrigerant sent from the outdoor heat exchanger 23 through the liquid refrigerant connection pipe 6 to the indoor expansion valves 41 and 51, and return the branched refrigerant to the suction side of the compressor 21. Specifically, the bypass refrigerant pipe 61 has a branching pipe 64 that is connected so as to allow some of the refrigerant sent from the outdoor expansion valve 38 to the indoor expansion valves 41 and 51 to branch from a position between the outdoor heat exchanger 23 and the subcooler 25, a merging pipe 65 that is connected to the suction side of the compressor 21 so as to return the branched refrigerant from the outlet on the bypass refrigerant pipe side of the subcooler 25 to the suction side of the compressor 21, and a bypass expansion valve 62 serving as a communication pipe expansion mechanism for resulting the flow rate of the refrigerant flowing through the bypass refrigerant pipe 61. Here, the bypass expansion valve 62 comprises an electrical expansion valve. Thus, the refrigerant sent from the outdoor heat exchanger 23 to the indoor expansion valves 41 and 51 is cooled in the subcooler 25 by the refrigerant flowing through the bypass pipe 61 after being depressurized by the bypass expansion valve 62. That is, in the subcooler 25, ability control becomes performed by regulating the opening degree of the bypass expansion valve 62. Further, the bypass refrigerant pipe 61 is, as described later, configured such that it also functions as a communication pipe that interconnects the portion of the refrigerant circuit 10 between the liquid-side stop valve 26 and the outdoor expansion valve 38 and the portion of the refrigerant circuit 10 on the suction side of the compressor 21. The bypass refrigerant pipe 61 is, in the present embodiment, disposed so as to allow the refrigerant to branch from a position between the receiver 24 and the subcooler 25, but the bypass refrigerant pipe 61 is not limited to this and may also be disposed so as to allow the refrigerant to branch from a position between the outdoor expansion valve 38 and the liquid-side stop valve 26.

The liquid-side stop valve 26 and the gas-side stop valve 27 are valves disposed in openings to which external devices and pipes (specifically, the liquid refrigerant connection pipe 6 and the gas refrigerant connection pipe 7) connect. The liquid-side stop valve 26 is placed on the downstream side of the receiver 24 and on the upstream side of the liquid refrigerant connection pipe 6 in the flow direction of the refrigerant in the refrigerant circuit 10 when performing the cooling operation (in the present embodiment, the liquid-side stop valve 26 is connected to the subcooler 25) and is also capable of cutting off passage of the refrigerant. The gas-side stop valve 27 is connected to the four-way switching valve 22.

Further, various types of sensors are disposed in the outdoor unit 2 in addition to the liquid level detection sensor 39 described above. Specifically, a suction pressure sensor 29 that detects the suction pressure of the compressor 21, a discharge pressure sensor 30 that detects the discharge pressure of the compressor 21, a suction temperature sensor 31 that detects the suction temperature of the compressor 21 and a discharge temperature sensor 32 that detects the discharge temperature of the compressor 21 are disposed in the outdoor unit 2. A liquid pipe temperature sensor 35 that detects the temperature of the refrigerant (that is, the liquid pipe temperature) is disposed in the outlet on the main refrigerant circuit side of the subcooler 25. A bypass temperature sensor 63 for detecting the temperature of the refrigerant flowing through the outlet on the bypass refrigerant pipe side of the subcooler 25 is disposed in the merging pipe 65 of the bypass refrigerant pipe 61. An outdoor temperature sensor 36 that detects the temperature of the outdoor air (that is, the outdoor temperature) flowing into the inside of the unit is disposed on an outdoor air suction opening side of the outdoor unit 2. In the present embodiment, the suction temperature sensor 31, the discharge temperature sensor 32, the liquid pipe temperature sensor 35, the outdoor temperature sensor 36 and the bypass temperature sensor 63 comprise thermistors. Further, the outdoor unit 2 has an outdoor-side controller 37 that controls the operation of each part configuring the outdoor unit 2. Additionally, the outdoor-side controller 37 has a microcomputer and a memory disposed in order to perform control of the outdoor unit 2 and an inverter circuit that controls the motor 21*m*, and the outdoor-side controller 37 is configured such that it can exchange control signals and the like via the transmission line 8*a* with the indoor-side controllers 47 and 57 of the indoor units 4 and 5. That is, a controller 8 that performs operation control of the entire air conditioning apparatus 1 is configured by the indoor-side controllers 47 and 57, the outdoor-side controller 37, and the transmission line 8*a* that interconnects the controllers 37, 47 and 57.

Figure 3:
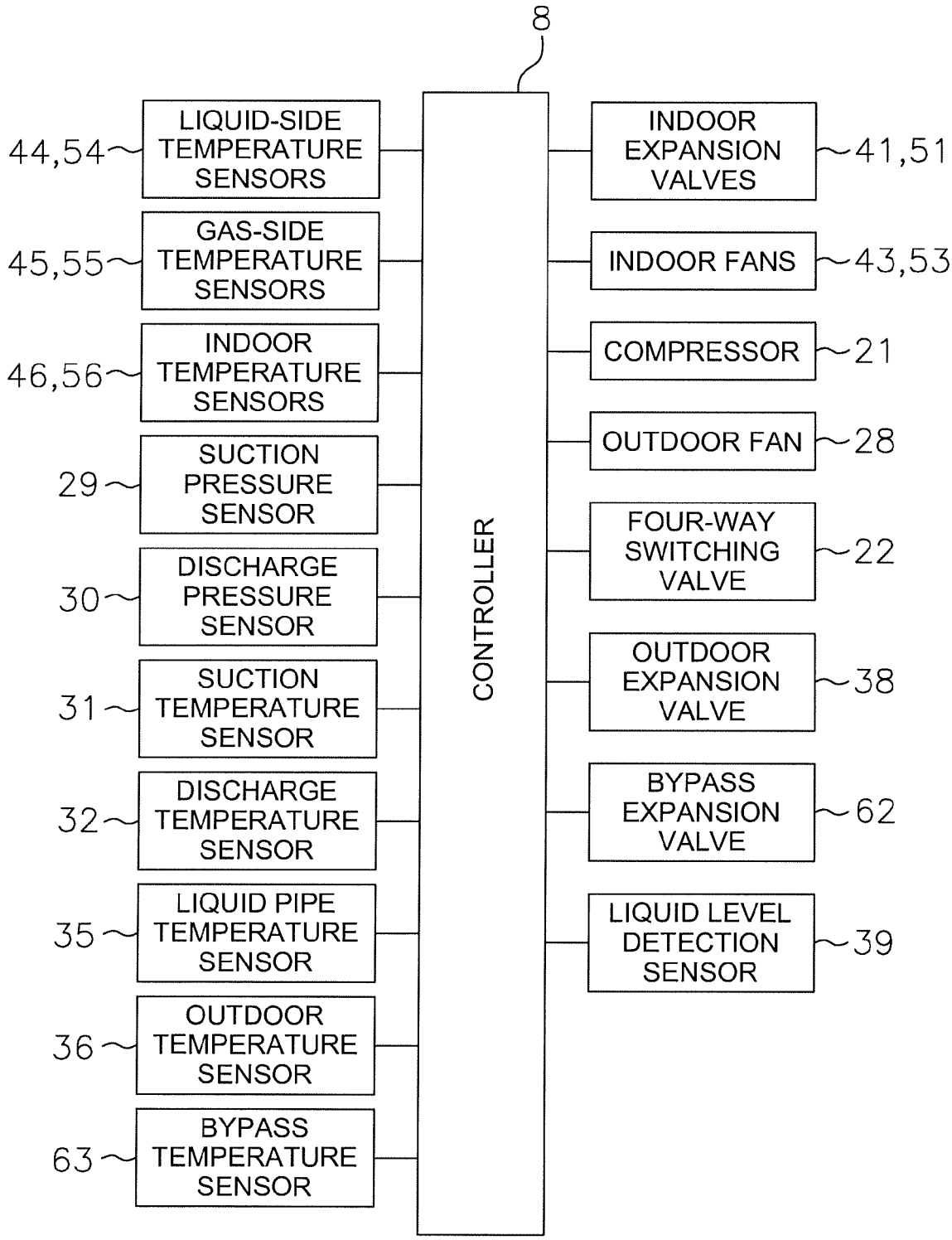
FIG. 3 is a control block diagram of the air conditioning apparatus.

The controller 8 is, as shown in FIG. 3, connected such that it can receive detection signals of the various types of sensors 29 to 32, 35, 36, 39, 44 to 46, 54 to 56 and 63 and is connected such that it can control the various types of devices and valves 21, 22, 28, 38, 41, 43, 51, 53 and 62 on the basis of these detection signals and the like. Further, various types of data are stored in a memory configuring the controller 8; for example, proper refrigerant quantity data of the refrigerant circuit 10 of the air conditioning apparatus 1 per property where, for example, pipe length has been considered after being installed in a building are stored. Additionally, when performing automatic refrigerant charging operation and refrigerant leak detection operation described later, the controller 8 reads these data, charges the refrigerant circuit 10 with just the proper quantity of the refrigerant, and judges whether or not there is a refrigerant leak by comparison with the proper refrigerant quantity data. Further, in the memory of the controller 8, liquid pipe fixed refrigerant quantity data (a liquid pipe fixed refrigerant quantity Y) and outdoor heat exchange collected refrigerant quantity data (an outdoor heat exchange collected refrigerant quantity X) are stored separately from the proper refrigerant quantity data (a proper refrigerant quantity Z), and the relationship of Z=X+Y is satisfied. Here, the liquid pipe fixed refrigerant quantity Y is a quantity of the refrigerant that is fixed in the portion from the liquid-side stop valve 26 via the liquid refrigerant connection pipe 6 to the indoor expansion valves 41 and 51 when operation described later which seals, with liquid refrigerant of a constant temperature, the portion from the downstream side of the outdoor heat exchanger 23 via the outdoor expansion valve 38, the receiver 24, the subcooler 25, the liquid-side stop valve 26 and the liquid refrigerant connection pipe 6 to the indoor expansion valves 41 and 51 has been performed. Further, the outdoor heat exchange collected refrigerant quantity X is a refrigerant quantity obtained by subtracting the liquid pipe fixed refrigerant quantity Y from the proper refrigerant quantity Z. Moreover, a relational expression with which the quantity of the refrigerant accumulated from the outdoor expansion valve 38 to the outdoor heat exchanger 23 can be calculated on the basis of data of the liquid level in the outdoor heat exchanger 23 is stored in the memory of the controller 8. Here, FIG. 3 is a control block diagram of the air conditioning apparatus 1.

<Refrigerant Connection Pipes>

The refrigerant connection pipes 6 and 7 are refrigerant pipes constructed on site when installing the air conditioning apparatus 1 in an installation location such as a building, and pipes having various lengths and pipe diameters are used depending on installation conditions such as the installation location and the combination of outdoor units and indoor units. For this reason, for example, when installing a new air conditioning apparatus, it is necessary to charge the air conditioning apparatus 1 with the proper quantity of the refrigerant corresponding to installation conditions such as the lengths and the pipe diameters of the refrigerant connection pipes 6 and 7.

As described above, the refrigerant circuit 10 of the air conditioning apparatus 1 is configured as a result of the indoor-side refrigerant circuits 10*a* and 10*b*, the outdoor-side refrigerant circuit 10*c* and the refrigerant connection pipes 6 and 7 being connected. Additionally, the air conditioning apparatus 1 of the present embodiment is configured to switch between the cooling operation and the heating operation with the four-way switch valve 22 and also to perform control of each device of the outdoor unit 2 and the indoor units 4 and 5 in accordance with the operating loads of the indoor units 4 and 5 with the controller 8 configured by the indoor-side controllers 47 and 57 and the outdoor-side controller 37.

(2) Operation of Air Conditioning Apparatus

Next, operation of the air conditioning apparatus 1 of the present embodiment will be described.

As operation modes of the air conditioning apparatus 1 of the present embodiment, there are a normal operation mode where control of the configural devices of the outdoor units 2 and the indoor units 4 and 5 is performed in accordance with the operating loads of each of the indoor units 4 and 5, the automatic refrigerant charging operation mode where the refrigerant circuit 10 is charged with the proper quantity of the refrigerant when test operation is performed, for example, after installation of the configural devices of the air conditioning apparatus 1, and the refrigerant leak detection operation mode where it is determined whether or not there is leakage of the refrigerant from the refrigerant circuit 10 after test operation including this automatic refrigerant charging operation is ended and normal operation is started.

Operation in each operation mode of the air conditioning apparatus 1 will be described below.

<Normal Operation Mode>

First, the cooling operation in the normal operation mode will be described using FIG. 1.

During the cooling operation, the four-way switching valve 22 is in the state indicated by the solid lines in FIG. 1, that is, a state where the discharge side of the compressor 21 is connected to the gas side of the outdoor heat exchanger 23 and where the suction side of the compressor 21 is connected to the gas sides of the indoor heat exchangers 42 and 52 via the gas-side stop valve 27 and the gas refrigerant connection pipe 7. Here, the outdoor expansion valve 38 is placed in a fully opened state. The liquid-side stop valve 26 and the gas-side stop valve 27 are placed in an open state. The opening degrees of each of the indoor expansion valves 41 and 51 are regulated such that the degree of superheating of the refrigerant in the outlets of the indoor heat exchangers 42 and 52 (that is, the gas sides of the indoor heat exchangers 42 and 52) becomes a degree-of-superheating target value and constant. In the present embodiment, the degree of superheating of the refrigerant in the outlets of each of the indoor heat exchangers 42 and 52 is detected by subtracting the refrigerant temperature values (which correspond to the evaporation temperatures) detected by the liquid-side temperature sensors 44 and 54 from the refrigerant temperature values detected by the gas-side temperature sensors 45 and 55 or is detected by converting the suction pressure of the compressor 21 detected by the suction pressure sensor 29 into a saturation temperature value corresponding to the evaporation temperature and subtracting this saturation temperature value of the refrigerant from the refrigerant temperature values detected by the gas-side temperature sensors 45 and 55. Although it is not employed in the present embodiment, the degree of superheating of the refrigerant in the outlets of each of the indoor heat exchangers 42 and 52 may also be detected by disposing temperature sensors that detect the temperature of the refrigerant flowing through the insides of each of the indoor heat exchangers 42 and 52 and subtracting the refrigerant temperature values corresponding to the evaporation temperatures detected by these temperature sensors from the refrigerant temperature values detected by the gas-side temperature sensors 45 and 55. Further, the opening degree of the bypass expansion valve 62 is regulated such that the degree of superheating of the refrigerant in the outlet on the bypass refrigerant pipe side of the subcooler 25 becomes a degree-of-superheating target value (called degree-of-superheating control below). In the present embodiment, the degree of superheating of the refrigerant in the outlet on the bypass refrigerant pipe side of the subcooler 25 is detected by converting the suction pressure of the compressor 21 detected by the suction pressure sensor 29 into a saturation temperature value corresponding to the evaporation temperature and subtracting this saturation temperature value of the refrigerant from the refrigerant temperature value detected by the bypass temperature sensor 63. Although it is not employed in the present embodiment, the degree of superheating of the refrigerant in the outlet on the bypass refrigerant pipe side of the subcooler 25 may also be detected by disposing a temperature sensor in the inlet on the bypass refrigerant pipe side of the subcooler 25 and subtracting the refrigerant temperature value detected by this temperature sensor from the refrigerant temperature value detected by the bypass temperature sensor 63.

When the compressor 21, the outdoor fan 28 and the indoor fans 43 and 53 are operated in this state of the refrigerant circuit 10, low-pressure gas refrigerant is sucked into the compressor 21, compressed, and becomes high-pressure gas refrigerant. Thereafter, the high-pressure gas refrigerant is sent to the outdoor heat exchanger 23 via the four-way switching valve 22, performs heat exchange with the outdoor air supplied by the outdoor fan 28, condenses, and becomes high-pressure liquid refrigerant. Then, this high-pressure liquid refrigerant passes through the outdoor expansion valve 38, is temporarily accumulated in the receiver 24, flows into the subcooler 25, performs heat exchange with the refrigerant flowing through the bypass refrigerant pipe 61, is further cooled, and reaches a subcooled state. At this time, some of the high-pressure liquid refrigerant condensed in the outdoor heat exchanger 23 is branched to the bypass refrigerant pipe 61, depressurized by the bypass expansion valve 62, and returned to the suction side of the compressor 21. Here, the refrigerant traveling through the bypass expansion valve 62 is depressurized until it becomes close to the suction pressure of the compressor 21, whereby some of that refrigerant evaporates. Then, the refrigerant flowing from the outlet of the bypass expansion valve 62 of the bypass refrigerant pipe 61 toward the suction side of the compressor 21 passes through the subcooler 25 and performs heat exchange with the high-pressure liquid refrigerant sent from the outdoor heat exchanger 23 on the main refrigerant circuit side to the indoor units 4 and 5.

Then, the high-pressure liquid refrigerant that has reached a subcooled state is sent to the indoor units 4 and 5 via the liquid-side stop valve 26 and the liquid refrigerant connection pipe 6.

This high-pressure liquid refrigerant sent to the indoor units 4 and 5 is depressurized until it becomes close to the suction pressure of the compressor 21 by the indoor expansion valves 41 and 51, becomes low-pressure refrigerant in a gas-liquid two-phase state, is sent to the indoor heat exchangers 42 and 52, and performs heat exchange with the room air, evaporates, and becomes low-pressure gas refrigerant in the indoor heat exchangers 42 and 52.

This low-pressure gas refrigerant is sent to the outdoor unit 2 via the gas refrigerant connection pipe 7 and is again sucked into the compressor 21 via the gas-side stop valve 27 and the four-way switching valve 22. In this manner, the air conditioning apparatus 1 is capable of performing at least cooling operation where the outdoor heat exchanger 23 is caused to function as a condenser of refrigerant compressed in the compressor 21 and where the indoor heat exchangers 42 and 52 are caused to function as evaporators of the refrigerant sent through the receiver 24, the liquid refrigerant connection pipe 6 and the indoor expansion valves 41 and 51 after being condensed in the outdoor heat exchanger 23.

Figure 4:
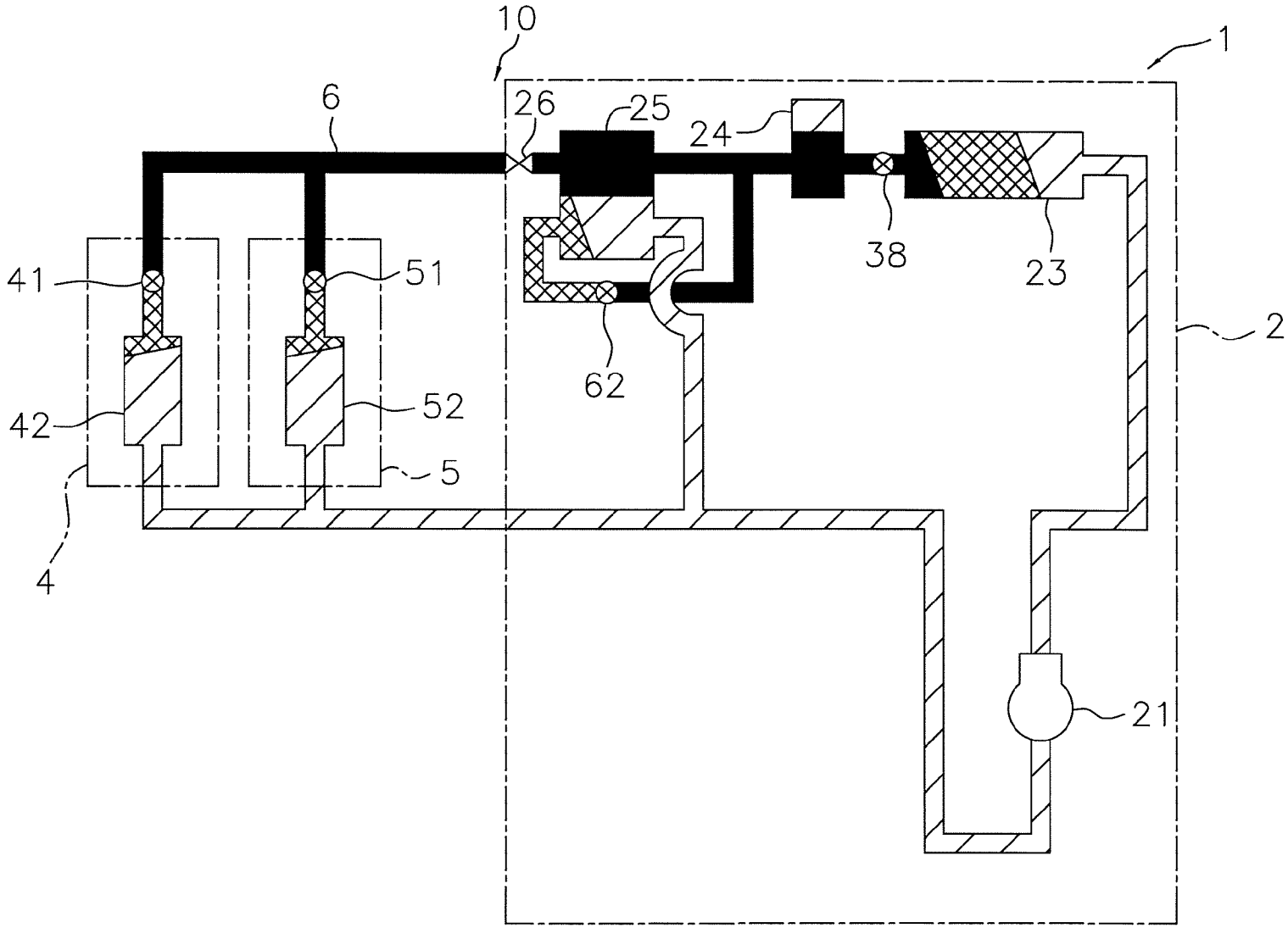
FIG. 4 is a schematic diagram showing states of refrigerant flowing through the inside of a refrigerant circuit in a cooling operation.

Here, the distribution state of the refrigerant in the refrigerant circuit 10 when performing the cooling operation in the normal operation mode is such that, as shown in FIG. 4, the refrigerant takes each of the states of a liquid state (the filled-in hatching portion in FIG. 4), a gas-liquid two-phase state (the grid-like hatching portions in FIG. 4) and a gas state (the diagonal line hatching portion in FIG. 4). Specifically, the portion from the portion near the outlet of the outdoor heat exchanger 23 via the outdoor expansion valve 38 to the inlet of the receiver 24, the liquid phase portion of the receiver 24 (that is, excluding the gas phase portion), the portion from the outlet of the receiver 24 via the portion on the main refrigerant circuit side of the subcooler 25 and the liquid refrigerant connection pipe 6 to the indoor expansion valves 41 and 51, and the portion on the upstream side of the bypass expansion valve 62 of the bypass refrigerant pipe 61 are charged with the refrigerant in the liquid state. Additionally, the portion in the middle of the outdoor heat exchanger 23, the portion on the downstream side of the bypass expansion valve 62 of the bypass refrigerant pipe 61, the portion on the bypass refrigerant pipe side and near the inlet of the subcooler 25, and the portions near the inlets of the indoor heat exchangers 42 and 52 are charged with the refrigerant in the gas-liquid two-phase state. Further, the portion from the portions in the middles of the indoor heat exchangers 42 and 52 via the gas refrigerant connection pipe 7 and the compressor 21 to the inlet of the outdoor heat exchanger 23, the portion near the inlet of the outdoor heat exchanger 23, and the portion from the portion on the bypass refrigerant pipe side and in the middle of the subcooler 25 to where the bypass refrigerant pipe 61 merges with the suction side of the compressor 21 are charged with the refrigerant in the gas state. Here, FIG. 4 is a schematic diagram showing states of the refrigerant flowing through the inside of the refrigerant circuit 10 in the cooling operation.

Figure 6:
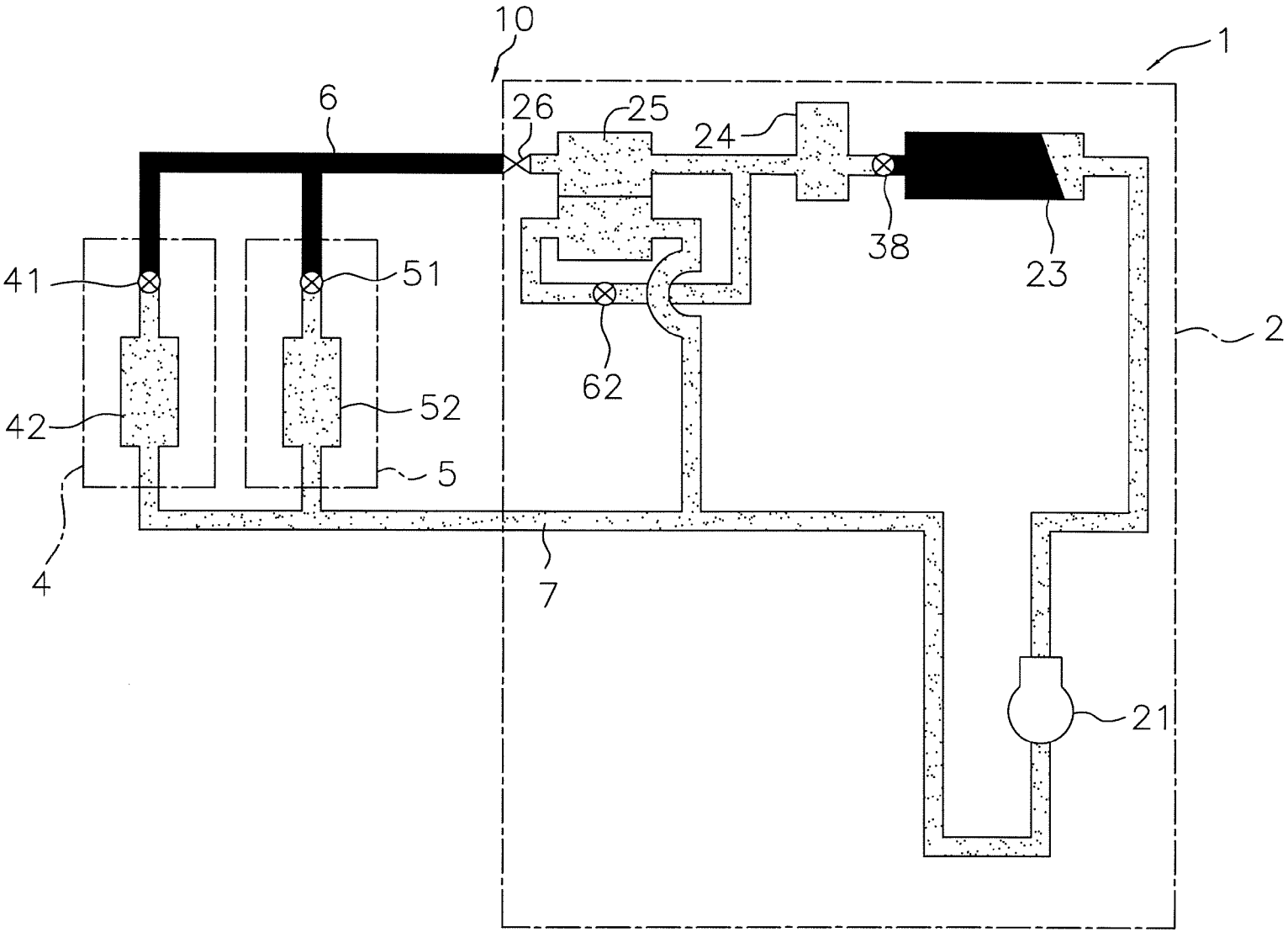
FIG. 6 is a schematic diagram showing states of the refrigerant flowing through the inside of the refrigerant circuit in the refrigerant quantity determination operation.

In the cooling operation in the normal operation mode, the refrigerant is distributed inside the refrigerant circuit 10 in this distribution, but in refrigerant quantity determination operation in the automatic refrigerant charging operation mode and in the refrigerant leak detection operation mode described later, the distribution becomes one where the liquid refrigerant is collected in the liquid refrigerant connection pipe 6 and in the outdoor heat exchanger 23 (see FIG. 6).

Next, the heating operation in the normal operation mode will be described.

During the heating operation, the four-way switching valve 22 is in the state indicated by the dotted lines in FIG. 1, that is, a state where the discharge side of the compressor 21 is connected to the gas sides of the indoor heat exchangers 42 and 52 via the gas-side stop valve 27 and the gas refrigerant connection pipe 7 and where the suction side of the compressor 21 is connected to the gas side of the outdoor heat exchanger 23. The opening degree of the outdoor expansion valve 38 is regulated in order to depressurize the refrigerant flowing into the outdoor heat exchanger 23 to a pressure capable of causing the refrigerant to evaporate in the outdoor heat exchanger 23 (that is, the evaporation pressure). Further, the liquid-side stop valve 26 and the gas-side stop valve 27 are placed in an open state. The opening degrees of the indoor expansion valves 41 and 51 are regulated such that the degree of subcooling of the refrigerant in the outlets of the indoor heat exchangers 42 and 52 becomes a degree-of-subcooling target value and constant. In the present embodiment, the degree of subcooling of the refrigerant in the outlets of the indoor heat exchangers 42 and 52 is detected by converting the discharge pressure of the compressor 21 detected by the discharge pressure sensor 30 into a saturation temperature value corresponding to the condensation temperature and subtracting the refrigerant temperature values detected by the liquid-side temperature sensors 44 and 54 from this saturation temperature value of the refrigerant. Although it is not employed in the present embodiment, the degree of subcooling of the refrigerant in the outlets of the indoor heat exchangers 42 and 52 may also be detected by disposing temperature sensors that detect the temperature of the refrigerant flowing through the insides of each of the indoor heat exchangers 42 and 52 and subtracting the refrigerant temperature values corresponding to the condensation temperatures detected by the temperature sensors from the refrigerant temperature values detected by the liquid-side temperature sensors 44 and 54. Further, the bypass expansion valve 62 is closed.

When the compressor 21, the outdoor fan 28 and the indoor fans 43 and 53 are operated in this state of the refrigerant circuit 10, low-pressure gas refrigerant is sucked into the compressor 21, compressed, becomes high-pressure gas refrigerant, and is sent to the indoor units 4 and 5 via the four-way switching valve 22, the gas-side stop valve 27 and the gas refrigerant connection pipe 7.

Then, the high-pressure gas refrigerant sent to the indoor units 4 and 5 performs heat exchange with the room air, condenses and becomes high-pressure liquid refrigerant in the indoor heat exchangers 42 and 52 and is thereafter depressurized in accordance with the valve opening degrees of the indoor expansion valves 41 and 51 when it passes through the indoor expansion valves 41 and 51.

This refrigerant traveling through the indoor expansion valves 41 and 51 is sent to the outdoor unit 2 via the liquid refrigerant connection pipe 6, is further depressurized via the liquid-side stop valve 26, the subcooler 25, the receiver 24 and the outdoor expansion valve 38, and thereafter flows into the outdoor heat exchanger 23. Then, the low-pressure refrigerant in the gas-liquid two-phase state flowing into the outdoor heat exchanger 23 performs heat exchange with the outdoor air supplied by the outdoor fan 28, evaporates, becomes low-pressure gas refrigerant, and is again sucked into the compressor 21 via the four-way switching valve 22.

Operation control in the normal operation mode described above is performed by the controller 8 (more specifically, the indoor-side controllers 47 and 57, the outdoor-side controller 37, and the transmission line 8*a* that interconnects the controllers 37, 47 and 57) functioning as an operation controlling element(means) that performs normal operation including the cooling operation and the heating operation.

<Automatic Refrigerant Charging Operation Mode>

Figure 5:
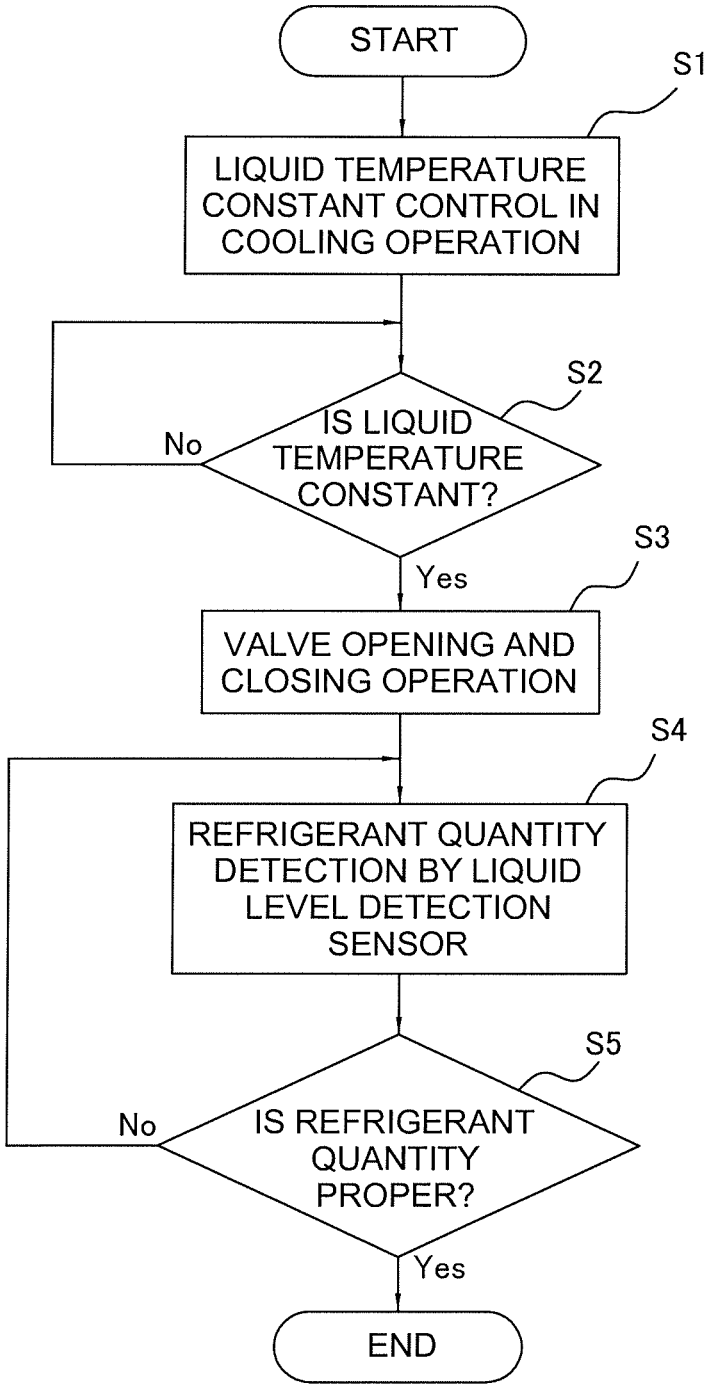
FIG. 5 is a flowchart of a refrigerant quantity determination operation.
Figure 7:
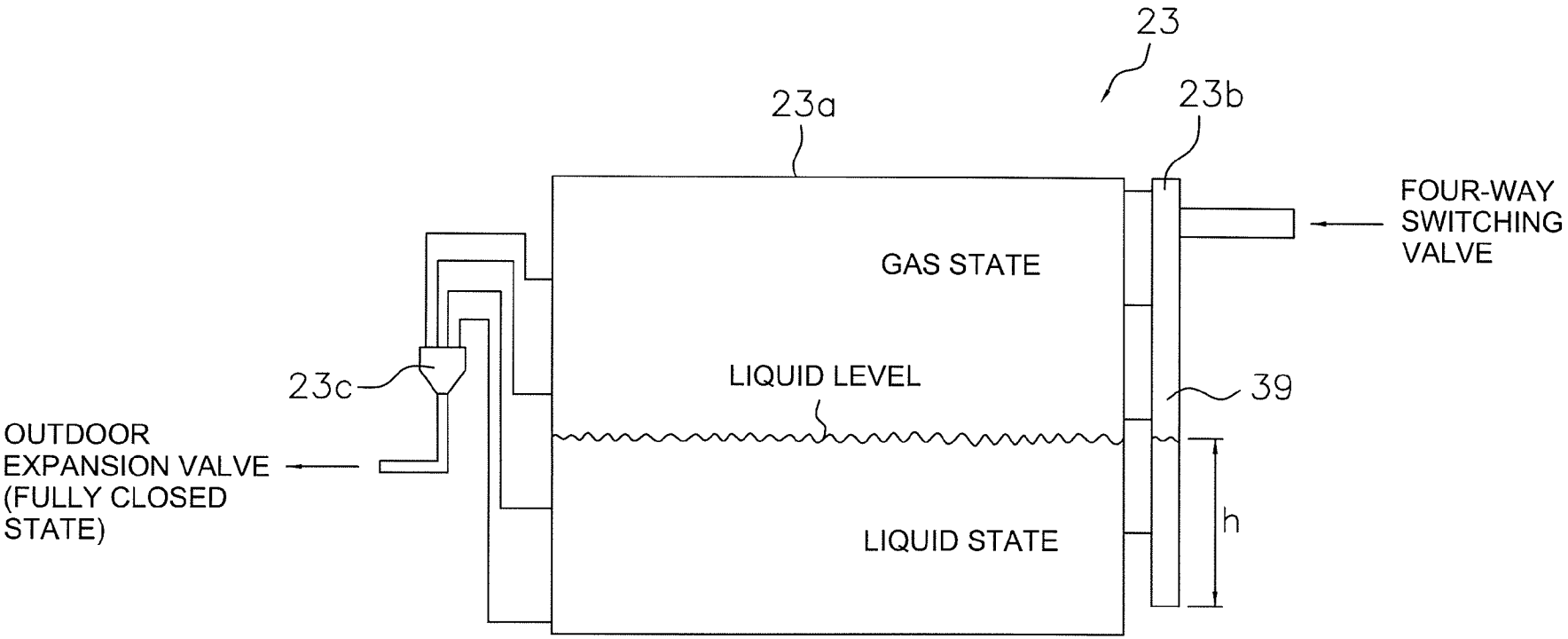
FIG. 7 is a diagram schematically showing the insides of a body of the heat exchanger and a header of FIG. 2 and shows the refrigerant accumulating in the outdoor heat exchanger in the refrigerant quantity determination operation.

Next, the automatic refrigerant charging operation mode performed at the time of test operation will be described using FIG. 5 to FIG. 7. Here, FIG. 5 is a flowchart of refrigerant quantity determination operation. FIG. 6 is a schematic diagram showing states of the refrigerant flowing through the inside of the refrigerant circuit 10 in the refrigerant quantity determination operation. FIG. 7 is a diagram schematically showing the insides of the heat exchanger body 23*a* and the header 23*b* of FIG. 2 and shows the refrigerant accumulating in the outdoor heat exchanger 23 in the refrigerant quantity determination operation.

The automatic refrigerant charging operation mode is an operation mode performed at the time of test operation, for example, after installation of the configural devices of the air conditioning apparatus 1 and is a mode where the refrigerant circuit 10 is automatically charged with the proper quantity of the refrigerant corresponding to the volumes of the liquid refrigerant connection pipe 6 and the gas refrigerant connection pipe 7.

First, the liquid-side stop valve 26 and the gas-side stop valve 27 of the outdoor unit 2 are opened and the refrigerant with which the outdoor unit 2 is charged beforehand is allowed to fill the inside of the refrigerant circuit 10.

Next, the worker performing the automatic refrigerant charging operation connects a refrigerant canister for additional charging to the refrigerant circuit 10 (for example, the suction side of the compressor 21) and starts charging.

Then, when the worker issues, directly or with a remote controller (not shown) or the like, a command to the controller 8 to start the automatic refrigerant charging operation, the refrigerant quantity determination operation and determination of the properness of the refrigerant quantity accompanied by the processing of step S1 to step S5 shown in FIG. 5 are performed by the controller 8.

First, in step S1, basically device control is performed such that the same operation as the cooling operation in the normal operation mode is performed. However, what differs from the cooling operation in the normal operation mode is that liquid temperature constant control is performed. In this liquid temperature constant control, condensation pressure control and liquid pipe temperature control are performed. In the condensation pressure control, the flow rate of the outdoor air supplied to the outdoor heat exchanger 23 by the outdoor fan 28 is controlled such that the condensation pressure of the refrigerant in the outdoor heat exchanger 23 becomes constant. The condensation pressure of the refrigerant in the condenser is greatly affected by the outdoor temperature, so the flow rate of the outdoor air supplied to the outdoor heat exchanger 23 from the outdoor fan 28 is controlled by the motor 28*m*. Thus, the condensation pressure of the refrigerant in the outdoor heat exchanger 23 becomes constant, and the state of the refrigerant flowing through the inside of the condenser stabilizes. Then, the high-pressure liquid refrigerant flows in the flow path from the outdoor heat exchanger 23 to the indoor expansion valves 41 and 51 including the outdoor expansion valve 38, the liquid phase portion of the receiver 24, the portion on the main refrigerant circuit side of the subcooler 25 and the liquid refrigerant connection pipe 6 and in the flow path from the outdoor heat exchanger 23 to the bypass expansion valve 62 of the bypass refrigerant pipe 61. Thus, the pressure of the refrigerant in the portion from the outdoor heat exchanger 23 to the indoor expansion valves 41 and 51 and bypass expansion valve 62 also becomes stable. In the condensation pressure control of the present embodiment, the discharge pressure of the compressor 21 detected by the discharge pressure sensor 30 is used as the condensation pressure. Although it is not employed in the present embodiment, a temperature sensor that detects the temperature of the refrigerant flowing through the inside of the outdoor heat exchanger 23 may also be disposed, and the refrigerant temperature value corresponding to the condensation temperature detected by this temperature sensor may be converted into the condensation pressure and used in the condensation pressure control. In the liquid pipe temperature control, in contrast to the degree-of-superheating control in the cooling operation in the normal operation mode described above, the ability of the subcooler 25 is controlled such that the temperature of the refrigerant sent from the subcooler 25 to the indoor expansion valves 41 and 51 becomes constant. More specifically, in the liquid pipe temperature control, the opening degree of the bypass expansion valve 62 of the bypass refrigerant pipe 61 is regulated such that the temperature of the refrigerant detected by the liquid pipe temperature sensor 35 disposed in the outlet on the main refrigerant circuit side of the subcooler 25 becomes a liquid pipe temperature target value and constant. Thus, the density of the refrigerant inside the refrigerant pipe including the liquid refrigerant connection pipe 6 from the outlet on the main refrigerant circuit side of the subcooler 25 to the indoor expansion valves 41 and 51 stabilizes.

Next, in step S2, it is judged whether or not the liquid temperature has become constant by performing the liquid temperature constant control of step S1. Here, when it is judged that the liquid temperature has become constant, the refrigerant quantity determination operation moves to step S3, and when it is judged that the liquid temperature has not yet become constant, the liquid temperature constant control of step S1 becomes continued. Additionally, when the liquid temperature is controlled to a constant by the liquid temperature constant control, the inside of the refrigerant pipe including the liquid refrigerant connection pipe 6 from the outlet on the main refrigerant circuit side of the subcooler 25 to the indoor expansion valves 41 and 51 of the filled-in hatching portion in FIG. 4 becomes stably sealed by the liquid refrigerant of the constant temperature.

Thus, before the liquid refrigerant is sealed, by the indoor expansion valves 41 and 51 and the liquid-side stop valve 26, in the portion of the refrigerant circuit 10 between the indoor expansion valves 41 and 51 and the liquid-side stop valve 26 including the liquid refrigerant connection pipe 6 in step S3 described later, the temperature of the refrigerant sent from the outdoor heat exchanger 23 through the liquid refrigerant connection pipe 6 to the indoor expansion valves 41 and 51 is regulated to be constant by the subcooler 25 and the liquid pipe fixed refrigerant quantity Y, which is a fixed quantity of the refrigerant, becomes held in the portion from the liquid-side stop valve 26 via the liquid refrigerant connection pipe 6 to the indoor expansion valves 41 and 51.

Next, in step S3, the indoor expansion valves 41 and 51 are placed in a fully closed state and the liquid-side stop valve 26 is placed in a fully closed state, whereby the liquid refrigerant is sealed in the portion of the refrigerant circuit 10 between the indoor expansion valves 41 and 51 and the liquid-side stop valve 26 including the liquid refrigerant connection pipe 6. Thus, circulation of the refrigerant is cut off with the liquid pipe fixed refrigerant quantity Y being held as is, and the liquid refrigerant of the accurate liquid pipe fixed refrigerant quantity Y where the temperature of the refrigerant has also been considered can be sealed in the portion of the refrigerant circuit 10 between the indoor expansion valves 41 and 51 and the liquid-side stop valve 26 including the liquid refrigerant connection pipe 6. Further, together with operation of the indoor expansion valves 41 and 51 and the liquid-side stop valve 26, the bypass expansion valve 62 is placed in a fully opened state and the outdoor expansion valve 38 is placed in a fully closed state, whereby passage of the refrigerant between the portion of the refrigerant circuit 10 between the liquid-side stop valve 26 and the outdoor expansion valve 38 including the receiver 24 and the other portion of the refrigerant circuit is shut off by the liquid-side stop valve 26 and the outdoor expansion valve 38, and the refrigerant in the portion of the refrigerant circuit 10 between the liquid-side stop valve 26 and the outdoor expansion valve 38 including the receiver 24 is placed, by the outdoor expansion valve 38 and the bypass refrigerant pipe 61, in a state where it is communicated with the suction side of the compressor 21. Here, even after the valves 41, 51, 26 and 38 have been placed in a fully closed state, operation of the compressor 21 and the outdoor fan 28 is continued. Thus, as shown in FIG. 6, the refrigerant condensed in the outdoor heat exchanger 23 functioning as a condenser is cooled and condensed in the outdoor heat exchanger 23 by the outdoor air supplied by the outdoor fan 28 and gradually accumulates in the portion of the refrigerant circuit 10 on the upstream side of the outdoor expansion valve 38 and on the downstream side of the compressor 21 such as in the outdoor heat exchanger 23 because circulation of the refrigerant inside the refrigerant circuit 10 is cut off by the outdoor expansion valve 38. Moreover, because of operation of the compressor 21, the refrigerant becomes virtually non-existent in the portion of the refrigerant circuit 10 on the downstream sides of the indoor expansion valves 41 and 51 and on the upstream side of the compressor 21 such as in the indoor heat exchangers 42 and 52 and the gas refrigerant connection pipe 7, and the refrigerant becomes virtually non-existent inside the receiver 24 also because the refrigerant inside the receiver 24 is also sucked into the compressor 21 through the bypass refrigerant pipe 61. Thus, the refrigerant inside the refrigerant circuit 10 becomes intensively collected in the portion of the refrigerant circuit 10 on the upstream side of the outdoor expansion valve 38 and on the downstream side of the compressor 21 without accumulating inside the receiver 24. More specifically, as shown in FIG. 7, the refrigerant that has been condensed into a liquid state accumulates inside the outdoor heat exchanger 23 from the upstream side of the outdoor expansion valve 38. As described above, the liquid refrigerant is sealed in the portion of the refrigerant circuit 10 between the indoor expansion valves 41 and 51 and the liquid-side stop valve 26 including the liquid refrigerant connection pipe 6, so the quantity of the liquid refrigerant accumulating inside the outdoor heat exchanger 23 from the upstream side of the outdoor expansion valve 38 including the liquid refrigerant accumulating inside the receiver 24 in the cooling operation in the normal operation mode does not become excessive.

Next, in step S4, the liquid level of the refrigerant accumulating in the outdoor heat exchanger 23 is detected by the liquid level detection sensor 39. Here, the liquid level detection sensor 39 detects, as the liquid level, the boundary between the region where the refrigerant exists in the gas state and the region where the refrigerant exists in the liquid state. Thus, the quantity of the refrigerant accumulated in the outdoor heat exchanger 23 from the outdoor expansion valve 38 is calculated by assigning the height h of the liquid level obtained by the liquid level detection sensor 39 (see FIG. 7) to the relational expression stored in the memory of the controller 8.

Next, in step S5, it is judged whether or not the refrigerant quantity calculated in step S4 described above has reached the outdoor heat exchange collected refrigerant quantity X stored in the memory of the controller 8. Here, when the refrigerant quantity has not reached the outdoor heat exchange collected refrigerant quantity X, the refrigerant quantity determination operation returns to the processing of step S4 and charging of the refrigerant circuit 10 with the refrigerant is continued, and when it is judged that the refrigerant quantity has reached the outdoor heat exchange collected refrigerant quantity X, charging of the refrigerant circuit 10 with the refrigerant is ended. Thus, the state quantity relating to the quantity of the refrigerant that has been collected in the portion of the refrigerant circuit 10 on the upstream side of the outdoor expansion valve 38 and on the downstream side of the compressor 21 can be detected by the liquid level detection sensor 39 while suppressing a drop in detection precision resulting from the refrigerant accumulating inside the receiver 24, can perform determination of the proper refrigerant quantity, and it becomes possible to perform determination of the proper refrigerant quantity while making the condition for performing determination relating to the refrigerant quantity simple.

In this manner, in the air conditioning apparatus 1, because of each type of the controls of steps S1 to S3 described above, the refrigerant quantity determination operation that performs operation where the refrigerant compressed in the compressor 21 is condensed in the outdoor heat exchanger 23 and accumulated in the portion on the upstream side of the outdoor expansion valve 38 including the outdoor heat exchanger 23 can be performed without accumulating the refrigerant inside the receiver 24, and because of the processing of steps S4 and S5 described above, the state quantity relating to the quantity of the refrigerant existing on the upstream side of the outdoor expansion valve 38 can be detected and the properness of the quantity of the refrigerant inside the refrigerant circuit 10 can be determined on the basis of the state quantity relating to the quantity of the refrigerant that the liquid level detection sensor 39 has detected in the refrigerant quantity determination operation.

Processing such as these controls is performed by the controller 8 (more specifically, the indoor-side controllers 47 and 57, the outdoor-side controller 37, and the transmission line 8*a* that interconnects the controllers 37, 47 and 57) functioning as the operation controlling element(means) that performs the refrigerant quantity determination operation and functioning as a refrigerant quantity determining element (means) that determines the properness of the quantity of the refrigerant inside the refrigerant circuit 10.

In the present embodiment, by performing the liquid temperature constant control (particularly the liquid pipe temperature control), a constant quantity of the refrigerant is always sealed in the portion of the refrigerant circuit 10 between the utilization side expansion mechanism and the first shut-off mechanism including the liquid refrigerant connection pipe 6, so even when the length of the liquid refrigerant connection pipe 6 configuring the refrigerant circuit 10 is long and the quantity of the refrigerant sealed in the liquid refrigerant connection pipe 6 by the processing of step S3 is relatively large, an accurate quantity of the refrigerant can be sealed in the liquid refrigerant connection pipe 6, and thus affects with respect to the quantity of the refrigerant in the portion of the refrigerant circuit 10 on the upstream side of the outdoor expansion valve 38 and on the downstream side of the compressor 21 can be suppressed so that stable detection of the state quantity relating to the refrigerant quantity by the liquid level detection sensor 39 can be performed, but when the length of the liquid refrigerant connection pipe 6 configuring the refrigerant circuit 10 is short and the quantity of the refrigerant sealed in the liquid refrigerant connection pipe 6 by the processing of step S3 is small, affects with respect to the quantity of the refrigerant in the portion of the refrigerant circuit 10 on the upstream side of the outdoor expansion valve 38 and on the downstream side of the compressor 21 are small, so it is not invariably necessary to perform the liquid temperature constant control (particularly the liquid pipe temperature control) and the processing of step S2 may also be omitted.

<Refrigerant Leak Detection Operation Mode>

Next, the refrigerant leak detection operation mode will be described.

The refrigerant leak detection operation mode is substantially the same as the automatic refrigerant charging operation mode excluding being accompanied by refrigerant charging work, so only the differences will be described.

In the present embodiment, the refrigerant leak detection operation mode is, for example, operation performed periodically (a time frame when it is not necessary to perform air conditioning, such as a holiday or late at night) when detecting whether or not the refrigerant is leaking to the outside from the refrigerant circuit 10 due to some accidental cause.

In the refrigerant leak detection operation, processing that is the same as the flowchart of the automatic refrigerant charging operation described above is performed.

That is, the cooling operation and the liquid temperature constant control are performed in the refrigerant circuit 10, and after the liquid temperature has become constant, the indoor expansion valves 41 and 51 and the liquid-side stop valve 26 are placed in a fully closed state to fix the liquid pipe fixed refrigerant quantity Y. Further, together with operation of the indoor expansion valves 41 and 51 and the liquid-side stop valve 26, the bypass expansion valve 62 is placed in a fully opened state, the outdoor expansion valve 38 is placed in a fully closed state, and the cooling operation is sustained, whereby the refrigerant quantity determination operation that accumulates the liquid refrigerant in the outdoor heat exchanger 23 is performed without accumulating the refrigerant inside the receiver 24.

Here, when the liquid level height h resulting from the liquid level detection sensor 39 is maintained as is without it changing during a predetermined amount of time, the liquid level height h at that time is assigned to the relational expression stored in the memory of the controller 8 to calculate a determined liquid refrigerant quantity X' accumulating in the outdoor heat exchanger 23 from the outdoor expansion valve 38. Here, it is judged whether or not there is a refrigerant leak in the refrigerant circuit 10 depending on whether or not the sum of the determined liquid refrigerant quantity X' that has been calculated and the liquid pipe fixed refrigerant quantity Y is equal to the proper refrigerant quantity Z.

After data of the liquid level height h have been acquired without the liquid level height h changing during the predetermined amount of time, operation of the compressor 21 is quickly stopped. Thus, the refrigerant leak detection operation is ended.

Further, determination of refrigerant leak detection is not limited to the method that calculates the determined liquid refrigerant quantity X' described above; for example, a reference liquid level height H corresponding to an optimum refrigerant quantity may also be calculated beforehand and stored in the memory of the controller 8, so that it is not necessary to perform calculation of the determined liquid refrigerant quantity X' described above, and the refrigerant leak detection may be performed by directly comparing the liquid level height h that is detected to the reference liquid level height H that becomes an index.

(3) Characteristics of Air Conditioning Apparatus and Refrigerant Quantity Determination Method The air conditioning apparatus 1 and the refrigerant quantity determination method of the present embodiment have the following characteristics.

<A>

In the air conditioning apparatus 1 of the present embodiment, the outdoor expansion valve 38 serving as a second shut-off mechanism is disposed on the downstream side of the outdoor heat exchanger 23 serving as a heat source-side heat exchanger and on the upstream side of the receiver 24 in the flow direction of the refrigerant in the refrigerant circuit 10 when performing the cooling operation, and the bypass refrigerant pipe 61 serving as a communication pipe that interconnects the portion of the refrigerant circuit 10 between the liquid-side stop valve 26 serving as a first shut-off mechanism and the outdoor expansion valve 38 and the portion of the refrigerant circuit 10 on the suction side of the compressor 21 is disposed, so there can be performed the refrigerant quantity determination operation where, when the cooling operation is performed, the liquid refrigerant is sealed, by the indoor expansion valves 41 and 51 serving as utilization-side expansion mechanisms and the liquid-side stop valve 26, in the portion of the refrigerant circuit 10 between the indoor expansion valves 41 and 51 and the liquid-side stop valve 26 including the liquid refrigerant connection pipe 6, passage of the refrigerant between the portion of the refrigerant circuit 10 between the liquid-side stop valve 26 and the outdoor expansion valve 38 including the receiver 24 and the other portion of the refrigerant circuit 10 is shut off by the liquid-side stop valve 26 and the outdoor expansion valve 38, and the portion of the refrigerant circuit 10 between the liquid-side stop valve 26 and the outdoor expansion valve 38 and the portion of the refrigerant circuit 10 on the suction side of the compressor is interconnected by the bypass refrigerant pipe 61. Additionally, when these operations are performed, the refrigerant condensed in the outdoor heat exchanger 23 functioning as a condenser gradually accumulates in the portion of the refrigerant circuit 10 on the upstream side of the outdoor expansion valve 38 and on the downstream side of the compressor 21 such as in the outdoor heat exchanger 23 because circulation of the refrigerant inside the refrigerant circuit 10 is cut off by the outdoor expansion valve 38. Moreover, because of operation of the compressor 21, the refrigerant becomes virtually nonexistent in the portion of the refrigerant circuit 10 on the downstream side of the indoor expansion valves 41 and 51 and on the upstream side of the compressor 21 such as in the indoor heat exchangers 42 and 52 and the gas refrigerant connection pipe 7, and the refrigerant becomes virtually nonexistent inside the receiver 24 also because the refrigerant inside the receiver 24 is also sucked into the compressor 21 through the bypass refrigerant pipe 61. Thus, the refrigerant inside the refrigerant circuit 10 becomes intensively collected in the portion of the refrigerant circuit 10 on the upstream side of the outdoor expansion valve 38 and on the downstream side of the compressor 21 without accumulating inside the receiver 24, so the state quantity relating to the quantity of the refrigerant that has been accumulated in this portion can be detected by the liquid level detection sensor 39 serving as a refrigerant detection mechanism while suppressing a drop in detection precision resulting from the refrigerant accumulating inside the receiver 24, and it is possible to perform determination of the proper refrigerant quantity.

Thus, in this air conditioning apparatus 1, it becomes possible to perform determination of the proper refrigerant quantity while making the condition for performing determination relating to the refrigerant quantity simple.

<B>

Additionally, the air conditioning apparatus 1 of the present embodiment can automatically perform at least determination of the properness of the refrigerant quantity because it is further equipped with the refrigerant quantity determining element(means) that performs determination of the refrigerant quantity described above. Further, in regard to step S3 in the refrigerant quantity determination operation (see FIG. 5), the liquid-side stop valve 26 is a manual valve, so it is preferable for the worker to manually input to the controller 8 the fact that he/she has placed the liquid-side stop valve 26 in a fully closed state or for a limit switch or the like that detects the fully closed state of the liquid-side stop valve 26 to be disposed, but the air conditioning apparatus 1 can substantially automatically perform determination of the properness of the refrigerant quantity.

<C>

Further, in the air conditioning apparatus 1 of the present embodiment, the temperature of the refrigerant in the liquid refrigerant connection pipe 6 can be regulated such that it becomes constant by the subcooler 25 serving as a temperature regulation mechanism before the liquid refrigerant is sealed in the portion of the refrigerant circuit 10 between the indoor expansion valves 41 and 51 and the outdoor expansion valve 38 including the liquid refrigerant connection pipe 6, so in the refrigerant quantity determination operation, an accurate quantity of the liquid refrigerant where the temperature of the refrigerant has also been considered can be sealed in the portion of the refrigerant circuit 10 between the indoor expansion valves 41 and 51 and the outdoor expansion valve 38 including the liquid refrigerant connection pipe 6.

Thus, for example, in the refrigerant quantity determination operation, a constant quantity of the refrigerant can always be sealed in the portion of the refrigerant circuit 10 between the indoor expansion valves 41 and 51 and the outdoor expansion valve 38 including the liquid refrigerant connection pipe 6, so even when the length of the liquid refrigerant connection pipe 6 configuring the refrigerant circuit 10 is long and the quantity of the refrigerant sealed in the liquid refrigerant connection pipe 6 is relatively large, an accurate quantity of the refrigerant can be sealed in the liquid refrigerant connection pipe 6, and thus affects with respect to the quantity of the refrigerant in the portion of the refrigerant circuit 10 on the upstream side of the outdoor expansion valve 38 and on the downstream side of the compressor 21 can be suppressed so that stable detection of the state quantity relating to the refrigerant quantity by the liquid level detection sensor 39 can be performed.

<D>

Further, in the air conditioning apparatus 1 of the present embodiment, the refrigerant flowing through the bypass refrigerant pipe 61 is used as a cooling source of the subcooler 25 for performing the liquid temperature constant control (more specifically, the liquid pipe temperature control), so in the refrigerant quantity determination operation, the configuration for placing the refrigerant in a state where it is virtually nonexistent inside the receiver 24 and the configuration for regulating the temperature of the refrigerant in the liquid refrigerant connection pipe 6 such that it becomes constant become used combinedly.

Thus, in this air conditioning apparatus 1, complication of the configuration for performing determination relating to the refrigerant quantity can be suppressed. Further, the bypass refrigerant pipe 61 is connected to a nozzle disposed in the receiver 24 in a state where the bypass refrigerant pipe 61 has been inserted as far as the bottom portion of the receiver 24, and the bypass refrigerant pipe 61 can draw out the liquid refrigerant inside the receiver 24, so it can quickly send the liquid refrigerant from the inside of the receiver 24 to the suction side of the compressor 21 during the refrigerant quantity determination operation.

(4) Modification 1

Figure 8:
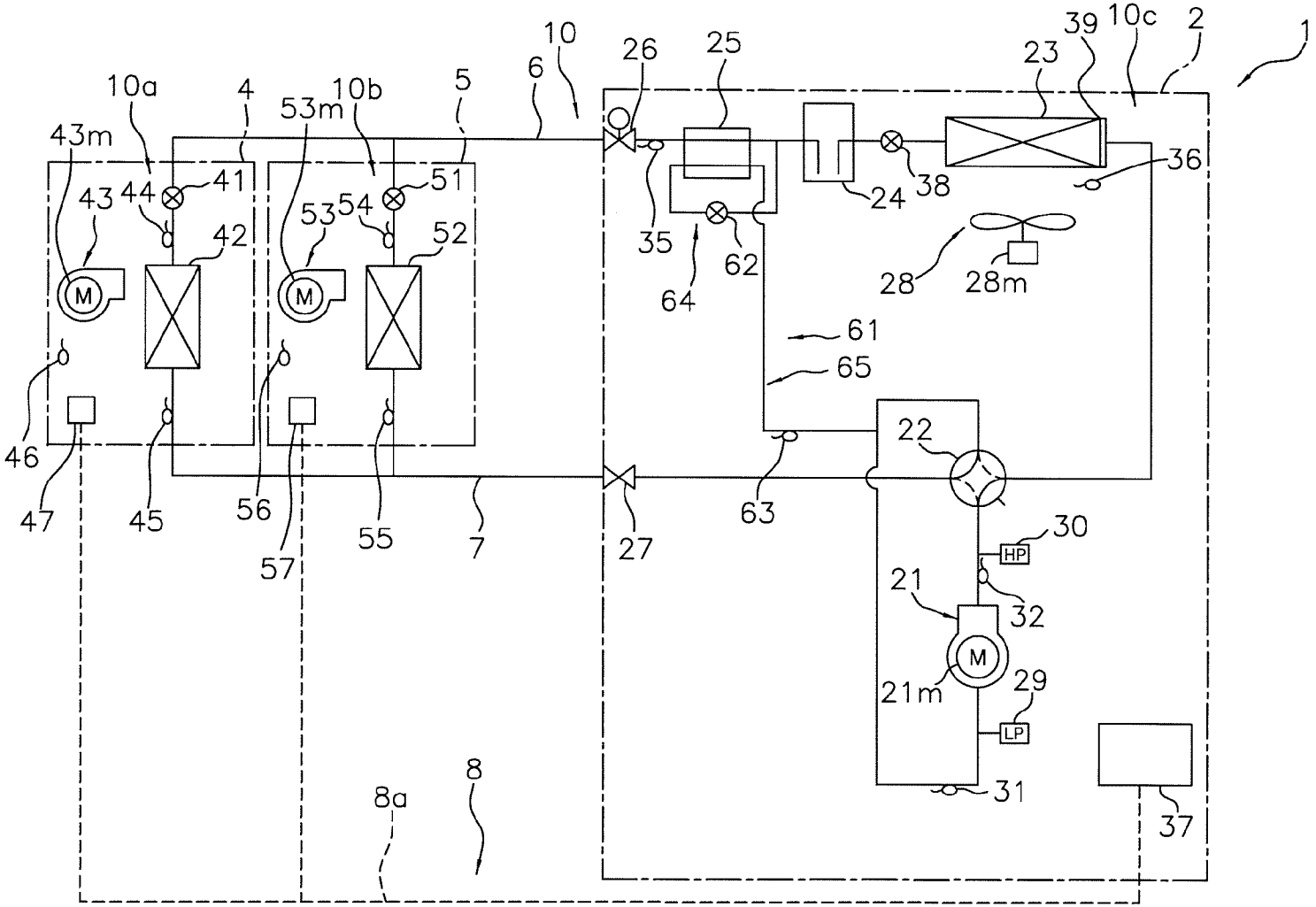
FIG. 8 is a general configuration diagram of an air conditioning apparatus according to modification 1 of the first embodiment.

In the embodiment described above, the liquid-side stop valve 26 is a manual valve, so in regard to step S3 in the refrigerant quantity determination operation (see FIG. 5), it is necessary for the worker to manually input to the controller 8 the fact that he/she has placed the liquid-side stop valve 26 in a fully closed state or for a limit switch or the like that detects the fully closed state of the liquid-side stop valve 26 to be disposed, but as shown in FIG. 8, for example, the liquid-side stop valve 26 may also be an automatic valve such as a solenoid valve that is capable of being opened and closed by the controller 8. Further, although it is not shown here, an automatic valve such as a solenoid valve that is capable of being opened and closed by the controller 8 may also be disposed between the liquid-side stop valve 26 and the subcooler 25 as an opening-and-closing valve that operates instead of the liquid-side stop valve 26 at the time of refrigerant quantity determination operation described above.

Thus, in addition to the effects in the embodiment described above, the refrigerant quantity determination operation can be completely automated.

(5) Modification 2

Figure 9:
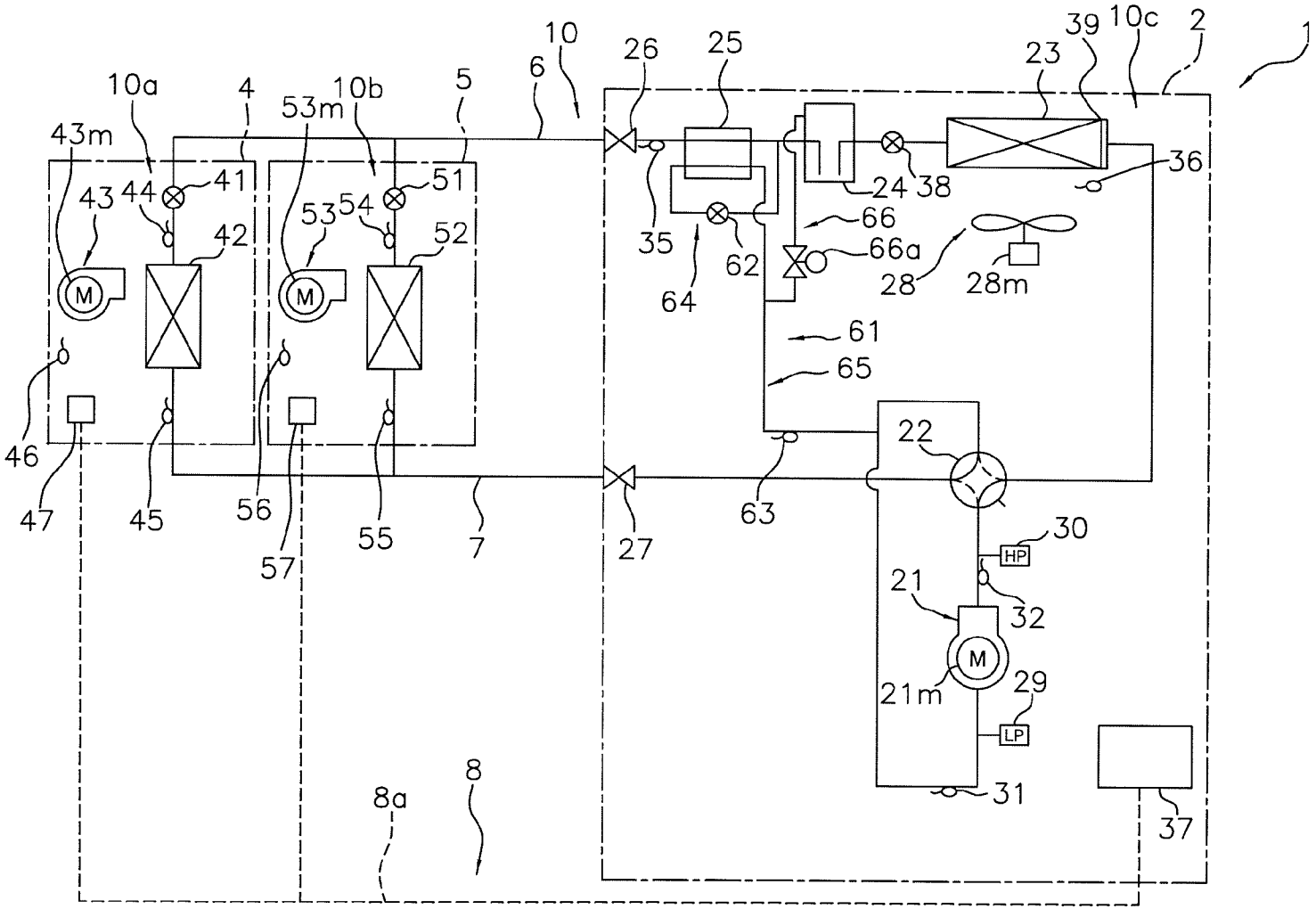
FIG. 9 is a general configuration diagram of an air conditioning apparatus according to modification 2 of the first embodiment.

In the embodiment described above and modification 1 thereof, the bypass refrigerant pipe 61 is used as a communication pipe for placing the refrigerant in a state where it is virtually nonexistent inside the receiver 24 and is used as a cooling source of the subcooler 25 for performing the liquid temperature constant control (more specifically, the liquid pipe temperature control) in refrigerant quantity determination operation, but as shown in FIG. 9, for example, a degassing refrigerant pipe 66 that sends the refrigerant from the gas phase portion of the receiver 24 (for example, the top portion of the receiver 24) to the suction side of the compressor 21 may also be disposed, and instead of the operation of placing the bypass expansion valve 62 in a fully opened state in step S3 of the refrigerant quantity determination operation (see FIG. 5) or together with the operation of placing the bypass expansion valve 62 in a fully opened state, an operation of placing a degassing opening-and-closing valve 66*a* disposed in this degassing refrigerant pipe 66 may also be performed. In the present modification, the degassing opening-and-closing valve 66*a* is a solenoid valve.

Even in this case, the effects in the embodiment described above and modification 1 thereof can be obtained.

(6) Modification 3

Figure 10:
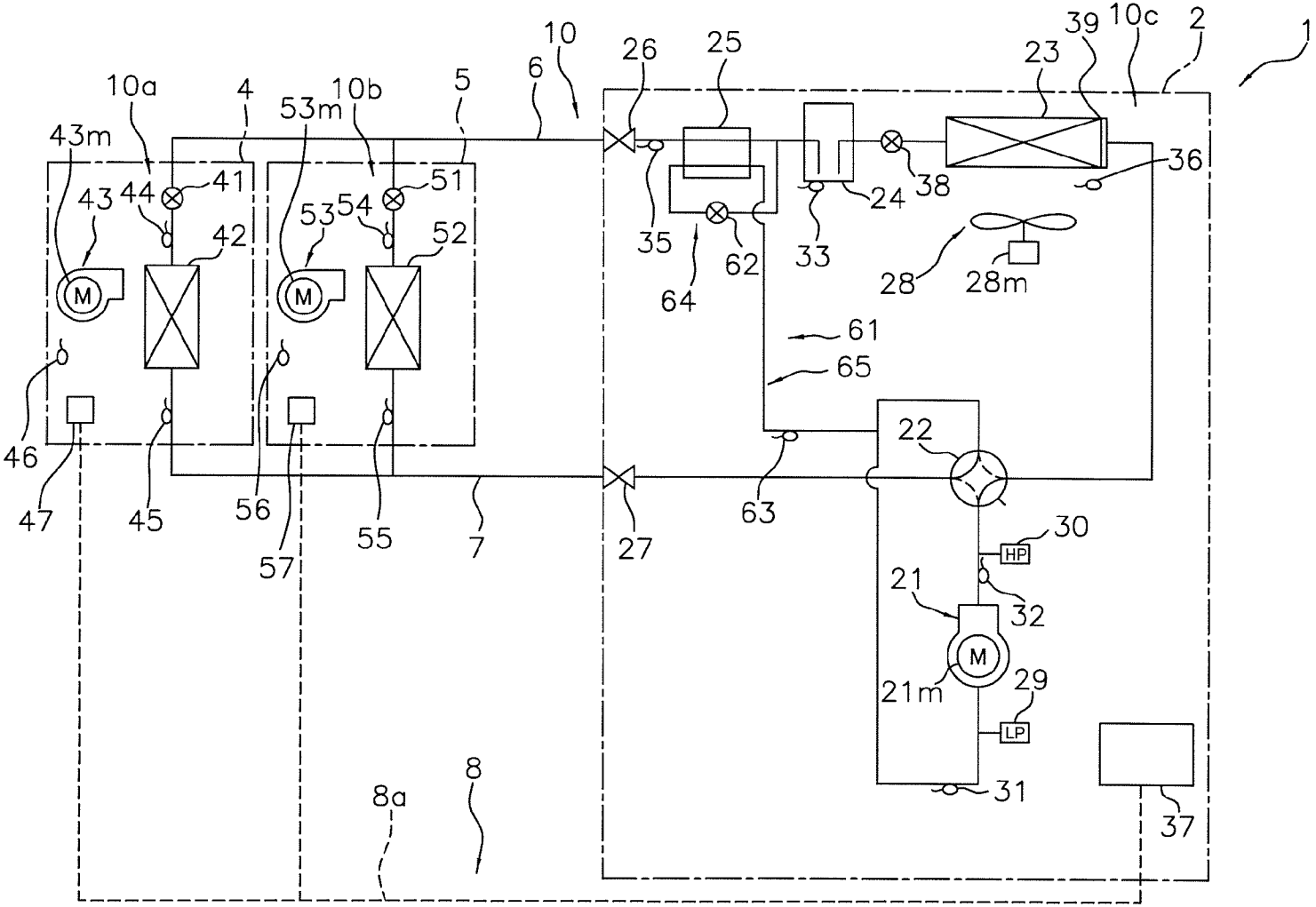
FIG. 10 is a general configuration diagram of an air conditioning apparatus according to modification 3 of the first embodiment.

In the embodiment described above and modifications 1 and 2 thereof, when the operation of placing the bypass expansion valve 62 in a fully opened state in step S3 of the refrigerant quantity determination operation (see FIG. 5) or the operation of placing the degassing opening-and-closing valve 66*a* in a fully opened state has been performed, judgment as to whether or not the liquid refrigerant inside the receiver 24 has completely disappeared is not actively performed, but as shown in FIG. 10, for example, a receiver bottom portion temperature sensor 33 serving as a receiver bottom portion temperature detection mechanism that detects the temperature of the refrigerant in the bottom portion of the receiver 24 may be disposed in the receiver 24, and whether or not the liquid refrigerant is accumulating inside the receiver 24 may be reliably detected on the basis of the temperature of the refrigerant detected by the receiver bottom portion temperature sensor 33 after the operation of the bypass expansion valve 62 or the degassing opening-and-closing valve 66*a* has been performed. More specifically, when the temperature of the refrigerant detected by the receiver bottom portion temperature sensor 33 is sufficiently higher than a value obtained by converting the pressure of the refrigerant detected by the suction pressure sensor 29 into a saturation temperature, it can be judged that the liquid refrigerant is nonexistent in the bottom portion of the receiver 24, and when the temperature of the refrigerant detected by the receiver bottom portion temperature sensor 33 is about the same as this saturation temperature, it can be judged that the liquid refrigerant still exists in the bottom portion of the receiver 24.

Thus, in addition to the effects in the embodiment described above and modifications 1 and 2 thereof, detection of the state quantity relating to the refrigerant quantity by the liquid level detection sensor 39 can be stably performed. Further, when only the degassing refrigerant pipe 66 is used to send the refrigerant from the inside of the receiver 24 to the suction side of the compressor 21, there is the fear that it will take time to draw out the liquid refrigerant from the inside of the receiver 24 as compared to when the bypass refrigerant pipe 61 is used to send the refrigerant from the inside of the receiver 24 to the suction side of the compressor 21 because the refrigerant is drawn out from the gas phase portion of the receiver 24, so detection by the receiver bottom portion temperature sensor 33 is effective.

Second Embodiment

Figure 11:
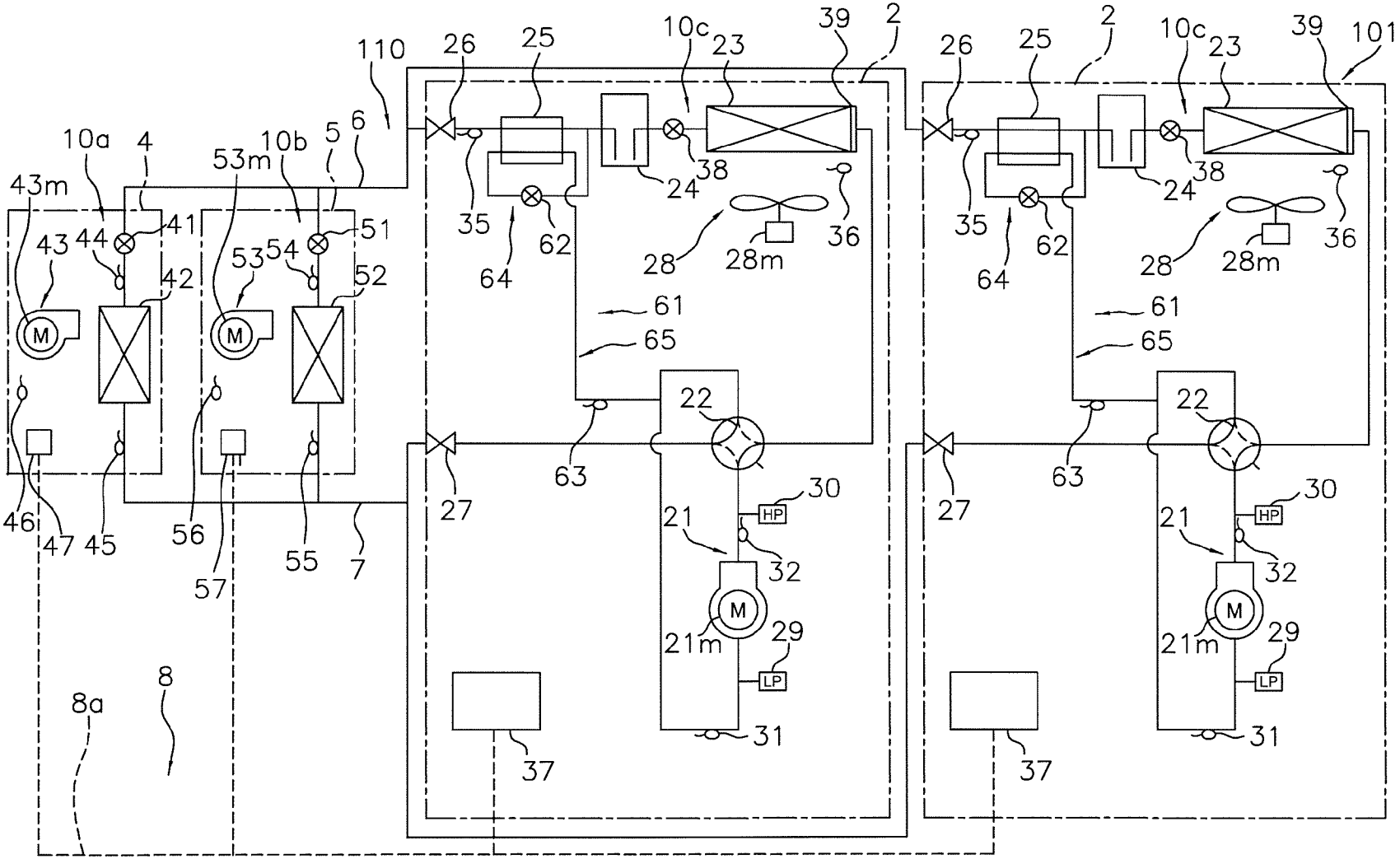
FIG. 11 is a general configuration diagram of an air conditioning apparatus according to a second embodiment.

In the air conditioning apparatus 1 of the first embodiment described above and the modifications thereof, a case where there is one outdoor unit has been taken as an example, but the invention is not limited to this and may also, for example, be given a configuration equipped with a plurality (in the present embodiment, two) of the outdoor units 2 in parallel such as in an air conditioning apparatus 101 of the present embodiment shown in FIG. 11. Here, the outdoor units 2 and the indoor units 4 and 5 have the same configurations as those of the outdoor unit 2 and the indoor units 4 and 5 in the first embodiment described above, so description will be omitted here.

In the air conditioning apparatus 101 of the present embodiment, what differs is that, in the automatic refrigerant charging operation and the refrigerant leak detection operation, detection by the liquid level detection sensors 39 is performed individually in each of the outdoor units 2 and judgment of whether or not the outdoor heat exchange collected refrigerant quantity X has accumulated is performed with respect to the quantity of the refrigerant inside the refrigerant circuit 110 where all of the outdoor units 2 are combined, but basically it is the same as determination of the properness of the quantity of the refrigerant inside the refrigerant circuit 10 in the first embodiment described above. Further, in the air conditioning apparatus 101 of the present embodiment also, the same configurations as in modifications 1 to 3 of the first embodiment described above may also be applied.

Third Embodiment

Figure 12:
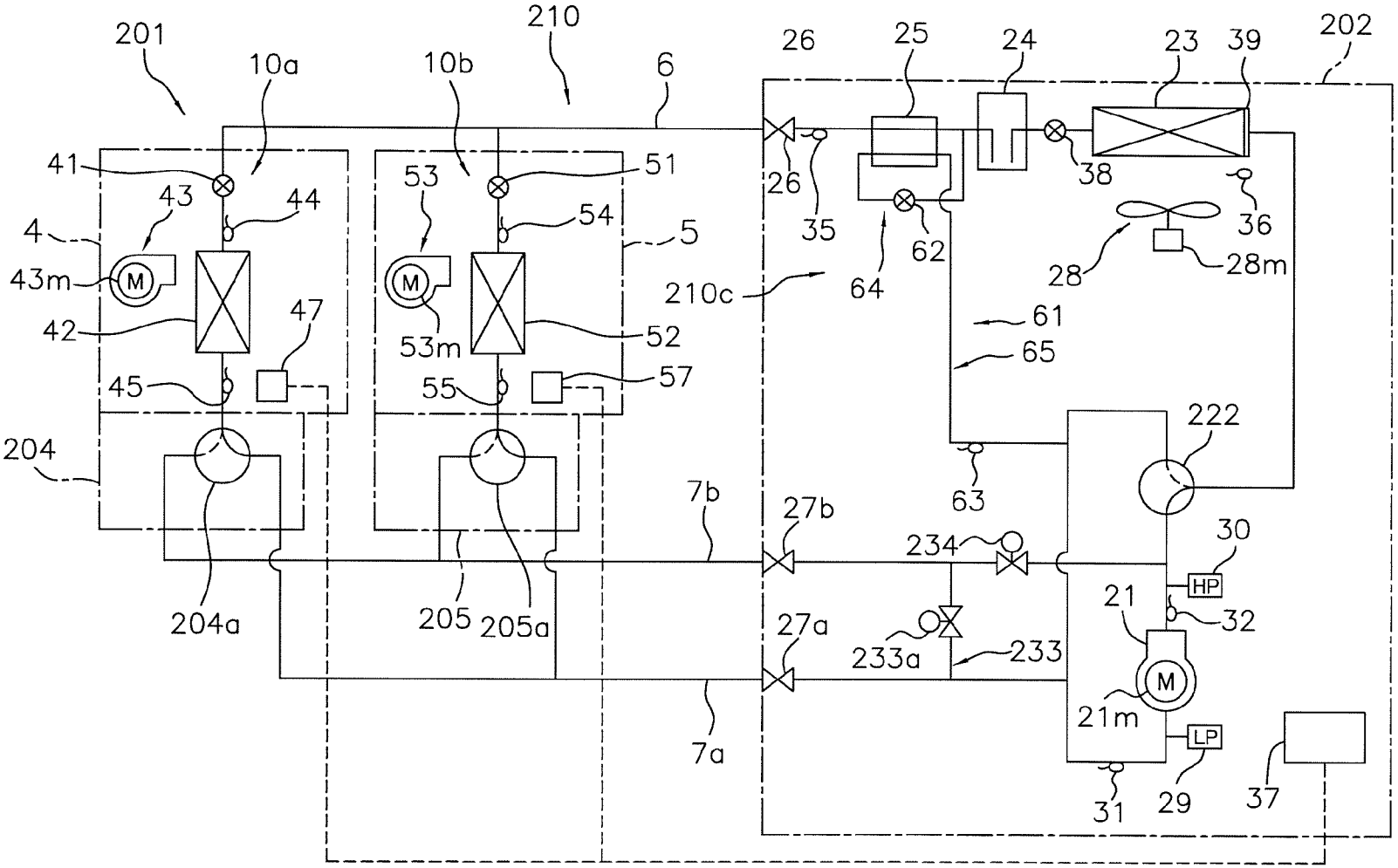
FIG. 12 is a general configuration diagram of an air conditioning apparatus according to a third embodiment.

In the air conditioning apparatus 1 and 101 of the first and second embodiments described above and the modifications thereof, a case where the present invention is applied with respect to a configuration capable of switching between cooling operation and heating operation has been taken as an example, but the present invention is not limited to this and may also, for example, be applied with respect to a configuration capable of simultaneous cooling and heating operation depending on the demands of each of the air-conditioned spaces inside the rooms where the indoor units 4 and 5 are installed such that, for example, cooling operation is performed in regard to a certain air-conditioned space while heating operation is performed in regard to another air-conditioned space such as in an air conditioning apparatus 201 of the present embodiment shown in FIG. 12.

The air conditioning apparatus 201 of the present embodiment is mainly equipped with plural (here, two) indoor units 4 and 5 serving as utilization units, an outdoor unit 202 serving as a heat source unit, and refrigerant connection pipes 6, 7*a* and 7*b*.

The indoor units 4 and 5 are connected to the outdoor unit 202 via a liquid refrigerant connection pipe 6, a suction gas refrigerant connection pipe 7*a* and a discharge gas refrigerant connection pipe 7*b* serving as gas refrigerant connection pipes, and connection units 204 and 205 and configure a refrigerant circuit 210 together with the outdoor unit 202. The indoor units 4 and 5 have the same configuration as that of the indoor units 4 and 5 in the first embodiment described above, so description will be omitted here.

The outdoor unit 202 mainly configures part of the refrigerant circuit 210 and is equipped with an outdoor-side refrigerant circuit 210*c*. The outdoor-side refrigerant circuit 210*c* mainly has a compressor 21, a three-way switching valve 222, an outdoor heat exchanger 23 serving as a heat source-side heat exchanger, a liquid level detection sensor 39 serving as a refrigerant detection mechanism, an outdoor expansion valve 38 serving as a second shut-off mechanism or a heat source-side expansion mechanism, a receiver 24, a subcooler 25 serving as a temperature regulation mechanism, a bypass refrigerant pipe 61 serving as a cooling source of the subcooler 25 and a communication pipe, a liquid-side stop valve 26 serving as a first shut-off mechanism, a suction gas-side stop valve 27*a*, a discharge gas-side stop valve 27*b*, a high-and-low-pressure communication pipe 233, a high-pressure shut-off valve 234, and an outdoor fan 28. Here, the devices and valves excluding the three-way switching valve 222, the suction gas-side stop valve 27*a*, the discharge gas-side stop valve 27*b*, the high-and-low-pressure communication pipe 233 and the high-pressure shut-off valve 234 have the same configurations as those of the devices and valves of the outdoor unit 2 in the first embodiment described above, so description will be omitted.

The three-way switching valve 222 is a valve for switching the flow path of the refrigerant inside the outdoor-side refrigerant circuit 210*c* so as to interconnect the discharge side of the compressor 21 and the gas side of the outdoor heat exchanger 23 when the outdoor heat exchanger 23 is caused to function as a condenser (called a condensation operation state below) and so as to interconnect the suction side of the compressor 21 and the gas side of the outdoor heat exchanger 23 when the outdoor heat exchanger 23 is caused to function as an evaporator (called an evaporation operation state below). Further, the discharge gas refrigerant connection pipe 7*b* is connected via the discharge gas-side stop valve 27*b* between the discharge side of the compressor 21 and the three-way switching valve 222. Thus, the high-pressure gas refrigerant compressed in and discharged from the compressor 21 can be supplied to the indoor units 4 and 5 regardless of the switching operation of the three-way switching valve 222. Further, the suction gas refrigerant connection pipe 7*a* is connected via the suction gas-side stop valve 27*a* to the suction side of the compressor 21. Thus, the low-pressure gas refrigerant returning from the indoor units 4 and 5 can be returned to the suction side of the compressor 21 regardless of the switching operation of the three-way switching valve 222. Further, the high-and-low-pressure communication pipe 233 is a refrigerant pipe that allows the refrigerant pipe interconnecting a position between the discharge side of the compressor 21 and the three-way switching valve 222 and the discharge gas refrigerant connection pipe 7*b* and the refrigerant pipe interconnecting the suction side of the compressor 21 and the suction gas refrigerant connection pipe 7*a* to be communicated with each other and has a high/low-pressure communication valve 233*a* that is capable of shutting off passage of the refrigerant. Thus, the suction gas refrigerant connection pipe 7*a* and the discharge gas refrigerant connection pipe 7*b* can be placed in a state where they are communicated with each other as needed. Further, the high-pressure shut-off valve 234 is disposed in the refrigerant pipe interconnecting a position between the discharge side of the compressor 21 and the three-way switching valve 222 and the discharge gas refrigerant connection pipe 7*b* and enables sending of the high-pressure gas refrigerant discharged from the compressor 21 to the discharge gas refrigerant connection pipe 7*b* to be shut off as needed. In the present embodiment, the high-pressure shut-off valve 234 is placed further on the discharge side of the compressor 21 than the position where the high-and-low-pressure communication pipe 233 is connected in the refrigerant pipe interconnecting a position between the discharge side of the compressor 21 and the three-way switching valve 222 and the discharge gas refrigerant connection pipe 7*b*. In the present embodiment, the high/low-pressure communication valve 233*a* and the high-pressure shut-off valve 234 are solenoid valves. In the present embodiment, the three-way switching valve 222 is used as the mechanism for switching between the condensation operation state and the evaporation operation state, but the mechanism is not limited to this, and a mechanism configured by a four-way switching valve or plural solenoid valves or the like may also be used.

Further, various types of sensors and an outdoor-side controller 37 are disposed in the outdoor unit 202, but these also have the same configurations as those of the various types of sensors and the outdoor-side controller 37 of the outdoor unit 2 in the first embodiment described above, so description will be omitted.

Further, the gas sides of the indoor heat exchangers 42 and 52 of the indoor units 4 and 5 are switchably connected to the suction gas refrigerant connection pipe 7*a* and the discharge gas refrigerant connection pipe 7*b* via the connection units 204 and 205. The connection units 204 and 205 are mainly equipped with cooling/heating switching valves 204*a* and 205*a*. The cooling/heating switching valves 204*a* and 205*a* are valves that function as switching mechanisms that perform switching between a state where they interconnect the gas sides of the indoor heat exchangers 42 and 52 of the indoor units 4 and 5 and the suction gas refrigerant connection pipe 7*a* when the indoor units 4 and 5 perform the cooling operation (called a cooling operation state below) and a state where they interconnect the gas sides of the indoor heat exchangers 42 and 52 of the indoor units 4 and 5 and the discharge gas refrigerant connection pipe 7*b* when the indoor units 4 and 5 perform the heating operation (called a heating operation state below). In the present embodiment, the cooling/heating switching valves 204*a* and 205*a* comprising three-way switching valves are used as the mechanisms for switching between the cooling operation state and the heating operation state, but the mechanisms are not limited thereto, and mechanisms configured by four-way switching valves or plural solenoid valves or the like may also be used.

Because of the configuration of this air conditioning apparatus 201, it becomes possible for the indoor units 4 and 5 to perform so-called simultaneous cooling and heating operation where, for example, the indoor unit 4 performs the cooling operation while the indoor unit 5 performs the heating operation.

Additionally, the air conditioning apparatus 201 capable of this simultaneous cooling and heating operation can perform the same refrigerant quantity determination operation and determination of the properness of the refrigerant quantity as the air conditioning apparatus 1 in the first embodiment described above by placing the three-way switching valve 222 in the condensation operation state to cause the outdoor heat exchanger 23 to function as a condenser of the refrigerant and placing the cooling/heating switching valves 204*a* and 205*a* in the cooling operation state to cause the indoor heat exchangers 42 and 52 to function as evaporators of the refrigerant.

However, the air conditioning apparatus 201 of the present embodiment has the suction gas refrigerant connection pipe 7*a* and the discharge gas refrigerant connection pipe 7*b* as the gas refrigerant connection pipe 7, so when the suction gas refrigerant connection pipe 7*a* and the discharge gas refrigerant connection pipe 7*b* are not communicated with each other and the refrigerant circuit is placed in a state where it is capable of sending the high-pressure gas refrigerant discharged from the compressor 21 to the discharge gas refrigerant connection pipe 7*b* by placing the high/low-pressure communication valve 233*a* in a fully closed state and placing the high-pressure shut-off valve 234 in a fully opened state such as in the cooling operation in the normal operation mode, there is the fear that the high-pressure gas refrigerant accumulated in the discharge gas refrigerant connection pipe 7*b* will become unable to be condensed in the outdoor heat exchanger 23 and accumulated in the portion on the upstream side of the outdoor expansion valve 38 including the outdoor heat exchanger 23 and that this will have an adverse affect on the determination precision of the properness of the quantity of the refrigerant inside the refrigerant circuit 10, so in the refrigerant quantity determination operation, the suction gas refrigerant connection pipe 7*a* and the discharge gas refrigerant connection pipe 7*b* are communicated with each other to shut off sending of the high-pressure gas refrigerant discharged from the compressor 21 to the discharge gas refrigerant connection pipe 7*b* by placing the high/low-pressure communication valve 233*a* in a fully closed state and placing the high-pressure shut-off valve 234 in a fully opened state. Thus, the pressure of the refrigerant inside the discharge gas refrigerant connection pipe 7*b* becomes the same as the pressure of the refrigerant inside the suction gas refrigerant connection pipe 7*a*, and the refrigerant does not accumulate in the discharge gas refrigerant connection pipe 7*b*, so the high-pressure gas refrigerant accumulated in the discharge gas refrigerant connection pipe 7*b* can be condensed in the outdoor heat exchanger 23 and accumulated in the portion on the upstream side of the outdoor expansion valve 38 including the outdoor heat exchanger 23, and it becomes difficult for this to have an adverse affect on the determination precision of the properness of the quantity of the refrigerant inside the refrigerant circuit 10.

In this manner, the air conditioning apparatus 201 of the present embodiment differs from the air conditioning apparatus 1 in the first embodiment described above in that it performs operation where the high/low-pressure communication valve 233*a* is placed in a fully closed state and the high pressure shut-off valve 234 is placed in a fully opened state to allow the suction gas refrigerant connection pipe 7*a* and the discharge gas refrigerant connection pipe 7*b* to be communicated with each other and shut off sending of the high-pressure gas refrigerant discharged from the compressor 21 to the discharge gas refrigerant connection pipe 7*b*, but basically it is the same as determination of the properness of the quantity of the refrigerant inside the refrigerant circuit 10 in the first embodiment described above. Further, in the air conditioning apparatus 201 of the present embodiment also, the same configurations of modifications 1 to 3 of the first embodiment described above may also be applied, and it may also be given a configuration where a plurality of the outdoor units 202 are connected such as in the air conditioning apparatus 101 of the second embodiment.

Other Embodiments

Embodiments of the present invention and modifications thereof have been described above on the basis of the drawings, but the specific configurations thereof are not limited to these embodiments and the modifications thereof and are alterable in a scope that does not depart from the gist of the invention.

For example, the present invention is also applicable to air conditioning apparatus dedicated to cooling operation rather than the air conditioning apparatus 1 and 101 that are capable of cooling operation and heating operation and the air conditioning apparatus 201 that is capable of performing cooling operation and heating operation simultaneously.

INDUSTRIAL APPLICABILITY

By utilizing the present invention, there can be provided an air conditioning apparatus and a refrigerant quantity determination method that are capable of making the condition necessary for performing determination of the properness of the quantity of the refrigerant simple while suppressing a drop in detection precision resulting from the refrigerant accumulating inside a receiver.

What is claimed is:

1. An air conditioning apparatus comprising:

a refrigerant circuit including a heat source having a compressor, a heat source-side heat exchange and a receiver, a utilization unit having a utilization-side expansion mechanism and a utilization-side heat exchanger, and a liquid refrigerant connection pipe and a gas refrigerant connection pipe interconnecting the heat source unit and the utilization unit, the refrigerant circuit being configured to at least perform a cooling operation in which the heat source-side heat exchanger functions as a condenser of refrigerant compressed in the compressor and the utilization-side heat exchanger functions as an evaporator of the refrigerant sent through the receiver, the liquid refrigerant connection pipe and the utilization-side expansion mechanism after being condensed in the heat source-side heat exchanger;

a first shut-off mechanism disposed on a downstream side of the receiver and on an upstream side of the liquid refrigerant connection pipe in the refrigerant circuit when the cooling operation is performed, the first shut-off mechanism being configured to shut off passage of the refrigerant;

a second shut-off mechanism disposed on a downstream side of the heat source-side heat exchanger and on an upstream side of the receiver in the refrigerant circuit when the cool operation is performed, the second shut-off mechanism being configured to shut off passage of the refrigerant;

a communication pipe interconnecting a portion of the refrigerant circuit between the first shut-off mechanism and the second shut-off mechanism and a portion of the refrigerant circuit on a suction side of the compressor;

a refrigerant detection mechanism disposed on an upstream side of the second shut-off mechanism in the refrigerant circuit when the cooling operation is performed, the refrigerant detection mechanism being configured to detect a state quantity relating to the quantity of the refrigerant existing on the upstream side of the second shut-off mechanism;

an operation controlling element configured to perform a refrigerant quantity determination operation in which liquid refrigerant is sealed by the utilization-side expansion mechanism and the first shut-off mechanism in a portion of the refrigerant circuit between the utilization-side expansion mechanism and the first shut-off mechanism including the liquid refrigerant connection pipe and refrigerant in the portion of the refrigerant circuit between the first shut-off mechanism and the second shut-off mechanism including the receiver is communicated with the suction side of the compressor by the second shut-off mechanism and the communication pipe so that the refrigerant compressed in the compressor is condensed in the heat source-side heat exchanger and accumulated in the portion of the refrigerant circuit on the upstream side of the second shut-off mechanism including the heat source-side heat exchanger; and a refrigerant quantity determining element configured to determine properness of the quantity of the refrigerant inside the refrigerant circuit based on the state quantity relating to the quantity of the refrigerant that the refrigerant detection mechanism has detected when the refrigerant quantity determination operation is performed.

2. The air conditioning apparatus according to claim 1, further comprising a temperature regulation mechanism configured to regulate temperature of the refrigerant sent from the heat source-side heat exchanger through the liquid refrigerant connection pipe to the utilization-side expansion mechanism before the liquid refrigerant is sealed, by the utilization-side expansion mechanism and the first shut-off mechanism, in the portion of the refrigerant circuit between the utilization-side expansion mechanism and the first shut-off mechanism including the liquid refrigerant connection pipe.

3. The air conditioning apparatus according to claim 2, wherein the temperature regulation mechanism is a subcooler connected between the heat source-side heat exchanger and the liquid refrigerant connection pipe, and the communication pipe has a communication pipe expansion mechanism configured to regulate the flow rate of the refrigerant, the communication pipe being configured such that some of the refrigerant sent from the heat source-side heat exchanger through the liquid refrigerant connection pipe to the utilization-side expansion mechanism branches from between the first shut-off mechanism and the second shut-off mechanism, the branched refrigerant is introduced to the subcooler after the branched refrigerant has been depressurized by the communication pipe expansion mechanism, the branched refrigerant exchanges heat with the refrigerant sent from the heat source-side heat exchanger through the liquid refrigerant connection pipe to the utilization-side expansion mechanism, and the branched refrigerant is returned to the suction side of the compressor.

4. The air conditioning apparatus according to claim 3, wherein the receiver includes a receiver bottom portion temperature detection mechanism disposed therein, the receiver bottom portion temperature detection mechanism being configured to detect temperature of the refrigerant in a bottom portion of the receiver.

5. The air conditioning apparatus according to claim 2, wherein the receiver includes a receiver bottom portion temperature detection mechanism disposed therein, the receiver bottom portion temperature detection mechanism being configured to detect temperature of the refrigerant in a bottom portion of the receiver.

6. The air conditioning apparatus according to claim 1, wherein the receiver includes a receiver bottom portion temperature detection mechanism disposed therein, the receiver bottom portion temperature detection mechanism being configured to detect temperature of the refrigerant in a bottom portion of the receiver.

7. The air conditioning apparatus according to claim 1, wherein the receiver includes a receiver bottom portion temperature detection mechanism disposed therein, the receiver bottom portion temperature detection mechanism being configured to detect temperature of the refrigerant in a bottom portion of the receiver.

8. A refrigerant quantity determination method for determining properness of the quantity of refrigerant in a refrigerant circuit including a heat source unit having a compressor, a heat source-side heat exchanger and a receiver, a utilization unit having a utilization-side expansion mechanism and a utilization-side heat exchanger, and a liquid refrigerant connection pipe and a gas refrigerant connection pipe interconnecting the heat source unit and the utilization unit, the refrigerant circuit being configured to at least perform a cooling operation in which the heat source-side heat exchanger functions as a condenser of refrigerant compressed in the compressor and the utilization-side heat exchanger functions as an evaporator of the refrigerant sent through the receiver, the liquid refrigerant connection pipe and the utilization-side expansion mechanism after being condensed in the heat source-side heat exchanger, the refrigerant quantity determination method comprising:

performing a refrigerant quantity determination operation in which liquid refrigerant is sealed by a first shut-off mechanism disposed on a downstream side of the receiver and on an upstream side of the liquid refrigerant connection pipe in the refrigerant circuit when performing the cooling operation and is capable of shutting off passage of the refrigerant and by the utilization-side expansion mechanism in a portion of the refrigerant circuit between the utilization-side expansion mechanism and the first shut-off mechanism including the liquid refrigerant connection pipe and a second shut-off mechanism disposed on a downstream de of the heat source-side heat exchanger and on an upstream side of the receiver in the refrigerant circuit when performing the cooling operation is capable of shutting off passage of the refrigerant, a communication pipe interconnects a portion of the refrigerant circuit between the first shut-off mechanism and the second shut-off mechanism and a portion of the refrigerant circuit on a suction side of the compressor, the refrigerant in the portion of the refrigerant circuit between the first shut-off mechanism and the second shut-off mechanism including the receiver is communicated with a suction side of the compressor so that the refrigerant compressed in the compressor is condensed in the heat source-side heat exchanger and accumulated in the portion of the refrigerant circuit on an upstream side of the second shut-off mechanism including the heat source-side heat exchanger;

detecting, with a refrigerant detection mechanism disposed on the upstream side of the second shut-off mechanism in the refrigerant circuit when performing the cooling operation, a state quantity relating to the quantity of the refrigerant existing on the upstream side of the second shut-off mechanism, the state quantity relating to the quantity of the refrigerant existing on the upstream side of the second shut-off mechanism; and determining the properness of the quantity of the refrigerant inside the refrigerant circuit based on the state quantity relating to the quantity of the refrigerant that the refrigerant detection mechanism has detected.

* * * * *

UNITED STATES PATENT AND TRADEMARK OFFICE

CERTIFICATE OF CORRECTION

PATENT NO. : 8,578,725 B2
APPLICATION NO. : 12/808729
DATED : November 12, 2013
INVENTOR(S) : Nishimura It is certified that error appears in the above-identified patent and that said Letters Patent is hereby corrected as shown below:

On the title page change the listing of Item [87] from

"[87] PCT Pub. No.: WO2009/008519
PCT Pub. Date: Jul. 9, 2009"

to

--[87] PCT Pub. No.: WO2009/084519
PCT Pub. Date: Jul. 9, 2009--

Signed and Sealed this
Eighth Day of July, 2014

Michelle K. Lee

Michelle K. Lee
*Deputy Director of the United States Patent and Trademark Office*